US008866843B1

(12) United States Patent
Lawson

(10) Patent No.: US 8,866,843 B1
(45) **Date of Patent: *Oct. 21, 2014**

(54) CLOCK OBJECTS HAVING VISUAL GRAPHICAL INDICATORS WITH INTERACTIVE TIME SHIFTING

(71) Applicant: Google Inc., Mountain View, CA (US)

(72) Inventor: Craig Lawson, Campbell, CA (US)

(73) Assignee: Google Inc., Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/787,208

(22) Filed: Mar. 6, 2013

Related U.S. Application Data

(63) Continuation of application No. 13/529,714, filed on Jun. 21, 2012, now Pat. No. 8,416,261.

(51) Int. Cl.
*G09G 5/00* (2006.01)
*G09G 5/36* (2006.01)
*G09G 5/37* (2006.01)

(52) U.S. Cl.
CPC . *G09G 5/363* (2013.01); *G09G 5/37* (2013.01)
USPC ..... 345/619; 345/672

(58) Field of Classification Search
USPC ..... 345/619, 672; 315/362; 715/810, 864; 386/21
See application file for complete search history.

(56) References Cited

U.S. PATENT DOCUMENTS 6,249,486 B1 6/2001 Chitturi
6,278,660 B1 8/2001 Tognazzini
2006/0136121 A1 6/2006 Eisen et al.
2009/0168609 A1 7/2009 Weir et al.
2009/0285056 A1 11/2009 Scott et al.
2010/0042445 A1 2/2010 Nicosia et al.
2010/0075648 A1 3/2010 Matsuoka et al.
2010/0085840 A1 4/2010 Lazaridis et al.
2010/0085841 A1 4/2010 Lazaridis et al.
2010/0085842 A1 4/2010 Lazaridis et al.
2010/0091615 A1 4/2010 Scott et al.
2011/0062896 A1 3/2011 Chou et al.
2011/0151415 A1 6/2011 Darling
2012/0027188 A1* 2/2012 Huynh et al. ..... 379/93.23
2012/0033531 A1 2/2012 Scott et al.
2012/0134240 A1 5/2012 Scott et al.

OTHER PUBLICATIONS

Apple, "iPhone User Guide for iOS 5.1 Software", Mar. 16, 2012, p. 1-179.*

(Continued)

*Primary Examiner* — Chante Harrison
(74) *Attorney, Agent, or Firm* — Troutman Sanders LLP; James E. Schutz; Christopher W. Glass

(57) ABSTRACT

The embodiments provide a data processing apparatus including a graphics controller configured to obtain a subset of selected time zones among a plurality of available time zones and generate a plurality of clock objects. Each clock object may be a graphical representation of a different time zone of the selected subset, and each clock object may provide a visual graphical indicator for a respective time zone. The data processing apparatus may include a user interface configured to display an arrangement of the plurality of clock objects and receive a command shifting to a travel mode time. The graphics controller may be configured to update the plurality of clock objects according to the command including providing an updated local time corresponding to the travel mode time for each selected time zone and adjusting the visual graphical indicator according to the updated local time for each selected time zone.

20 Claims, 15 Drawing Sheets

(56) References Cited

OTHER PUBLICATIONS

"Scheduling Across Time Zones", Google Calendar Help, retrieved on Dec. 3, 2012 from support.google.com/calendar/bin/answer.py?hl=en&answer=179200, 3 pages.

Hoy, et al, "Time Zones", retrieved on Dec. 3, 2012 from everytimezone.com, 1 page.

Non-Final Office Action for U.S. Appl. No. 13/529,714, mailed Sep. 7, 2012, 13 pages.

Non-Final Office Action Response for U.S. Appl. No. 13/529,714, filed Dec. 3, 2012, 15 pages.

Notice of Allowance for U.S. Appl. No. 13/529,714, mailed Dec. 18, 2012, 12 pages.

* cited by examiner

CLOCK OBJECTS HAVING VISUAL GRAPHICAL INDICATORS WITH INTERACTIVE TIME SHIFTING

CROSS-REFERENCE TO RELATED APPLICATIONS

This application claims priority under 35 U.S.C. 120 to, and is a continuation of, U.S. patent application Ser. No. 13/529,714, titled CLOCK OBJECTS HAVING VISUAL GRAPHICAL INDICATORS WITH INTERACTIVE TIME SHIFTING, filed on Jun. 21, 2012.

BACKGROUND

In today's environment, scheduling teleconferences, phone calls, video teleconferences or other interactions involving a number of people in different time zones is a common occurrence. Typically, a meeting planner must determine which time zone each participant is located, and then manually calculate a preferred time across the different time zones that is suitable for each participant, which may be a cumbersome task. A few conventional applications and/or websites currently exist that may assist the user in scheduling such a meeting across multiple time zones, as explained below.

In one conventional application, the current local time in a selected set of time zones is displayed, thereby permitting the user to select a time in order to schedule an event such as a teleconference. When such an event is created, the application displays the event time across all selected time zones. However, in order to change the input of the time computation, the user must create a new event. As such, if the event time turns out to be not suitable in the relevant time zones, the user must then delete the event and create a new event at a different time. In another conventional application, the current local time in a set of default time zones is displayed. The user may adjust the current local time to a future time (and vice versa), which the application, then, re-calculates the current local time in each of the default time zones. The user may adjust the current local time and view the re-calculated local time in each default time zone until a suitable time is found. However, these and other conventional approaches are not entirely user-friendly, flexible and/or intuitive.

SUMMARY

The details of one or more implementations are set forth in the accompanying drawings and the description below. Other features will be apparent from the description and drawings, and from the claims.

The embodiments provide a data processing apparatus including a graphics controller configured to obtain a subset of selected time zones among a plurality of available time zones and generate a plurality of clock objects. Each clock object may be a graphical representation of a different time zone of the selected subset, and each clock object may provide a visual graphical indicator for a respective time zone. The data processing apparatus may include a user interface configured to display an arrangement of the plurality of clock objects and receive a command shifting to a travel mode time. The graphics controller may be configured to update the plurality of clock objects according to the command including providing an updated local time corresponding to the travel mode time for each selected time zone and adjusting the visual graphical indicator according to the updated local time for each selected time zone.

According to one embodiment, the graphics controller may be configured to update the plurality of clock objects over a period of time having a plurality of time intervals such that a local time is updated and the visual graphical indicator is adjusted at each time interval according to the travel mode time at a respective time interval.

The graphics controller configured to obtain a subset of selected time zones among a plurality of available time zones may include selecting a default number of time zones.

The data processing apparatus may further include a user preferences database configured to store the subset of selected time zones, and the graphics controller is configured to obtain a subset of selected time zones among a plurality of available time zones may include obtaining the subset of selected times zones from the user preferences database.

Each clock object may include a background color, and the graphics controller may be configured to change the background color for each clock object according to the updated local time for a respective selected time zone. According to one embodiment, at least one of the plurality of clock objects may include a time zone indicator that indicates a current time zone of a user.

Also, each clock object may provide a day name, month name and day of month corresponding to a current local time, and the graphics controller may be configured to update one or more of the day name, the month name and the day of month according to the updated local time for one or more of the selected time zones.

The visual graphical indicator may include one of a graphical representation of a sun and a graphical representation of a moon. The graphics controller configured to adjust the visual graphical indicator may include changing a position of the visual graphical indicator on each clock object. The graphics controller configured to adjust the visual graphical indicator may include drawing the visual graphical indicator differently depending on a velocity of a movement on the user interface. The user interface configured to receive a command shifting to a travel mode time may include receiving information indicating a gesture from a user on the user interface.

The data processing apparatus may further include an application launcher configured to launch an application based on a secondary command. The application may be one of a calendar application, a voice application, and a text message application. The application launcher may be configured to populate a calendar entry of the calendar application with the updated local time.

The data processing apparatus may further include a hierarchical list generator configured to generate a hierarchical list of the plurality of available time zones. The hierarchical list may arrange the plurality of available time zones in a tree structure having a plurality of levels including a top level. The top level may provide a time zone category and a world region category. The user interface may be configured to display the plurality of available times zones according to the hierarchical list in order to permit a user to edit the subset of selected time zones.

The embodiments may provide a method for updating time zone data across multiple time zones by at least one processor. The method may include obtaining, by the at least one processor, a subset of selected time zones among a plurality of available time zones, and generating, by the at least one processor, a plurality of clock objects. Each clock object may be a graphical representation of a different time zone of the selected subset, and each clock object may provide a visual graphical indicator for a respective time zone. The method may further include displaying, by the at least one processor, an arrangement of the plurality of clock objects on a user interface, receiving, by the at least one processor, a command shifting to a travel mode time, and updating, by the at least one processor, the plurality of clock objects according to the command. The updating step may include providing an updated local time corresponding to the travel mode time for each selected time zone and adjusting the visual graphical indicator according to the updated local time for each selected time zone.

The updating the plurality of clock objects according to the command may include updating the plurality of clock objects over a period of time having a plurality of time intervals such that a local time is updated and the visual graphical indicator is adjusted at each time interval according to the travel mode time at a respective time interval.

The embodiments may provide a non-transitory computer-readable medium storing instructions that when executed cause one or more processors to perform a process. The instructions comprise instructions to obtain a subset of selected time zones among a plurality of available time zones and generate a plurality of clock objects. Each clock object may be a graphical representation of a different time zone of the selected subset, and each clock object may provide a visual graphical indicator for a respective time zone. The instructions may comprise instructions to display an arrangement of the plurality of clock objects on a user interface, receive a command shifting to a travel mode time, and to update the plurality of clock objects according to the command including providing an updated local time corresponding to the travel mode time for each selected time zone, and adjusting the visual graphical indicator according to the updated local time for each selected time zone.

DETAILED DESCRIPTION

The embodiments provide a data processing apparatus including a graphics controller that generates a plurality of clock objects, where each clock object may be a graphical representation of a different time zone among a selected set of time zones. The clock objects may be graphically arranged on a user interface such as a smart phone display screen or display screen of a personal computer, for example. In one particular example, each clock object may be a horizontal rectangle, and the horizontal rectangles may be arranged as vertically adjacent rows on the user interface. Initially, each clock object may provide the display name of a respective time zone, the day name (e.g., Monday, Tuesday, Wednesday, etc.), the current local time, and a visual graphical indicator for a respective time zone. Also, each clock object may provide the month name and day of the month. Further, each clock object may have a background color that is based on the current local time. The visual graphical indicator may be a representation of the sun or moon that is located at a particular position within the clock object according to its local time, which provides the user with a visual cue indicating the time of day.

Subsequently, the user interface receives a user command shifting the current time to a travel mode time, and the graphics controller may update the local time, the day name, the month name and the day of the month, the background color, and/or the visual graphical indicator based on the travel mode time. In one embodiment, a user may drag a finger across the user interface encompassing the clock objects, which changes the current time to the travel mode time, whereby the graphics controller updates the local time, the day name, the background color, and/or the visual graphical indicator based on the updated local time for each selected time zone. These and other features are further explained below with reference to the figures.

Figure 1A:
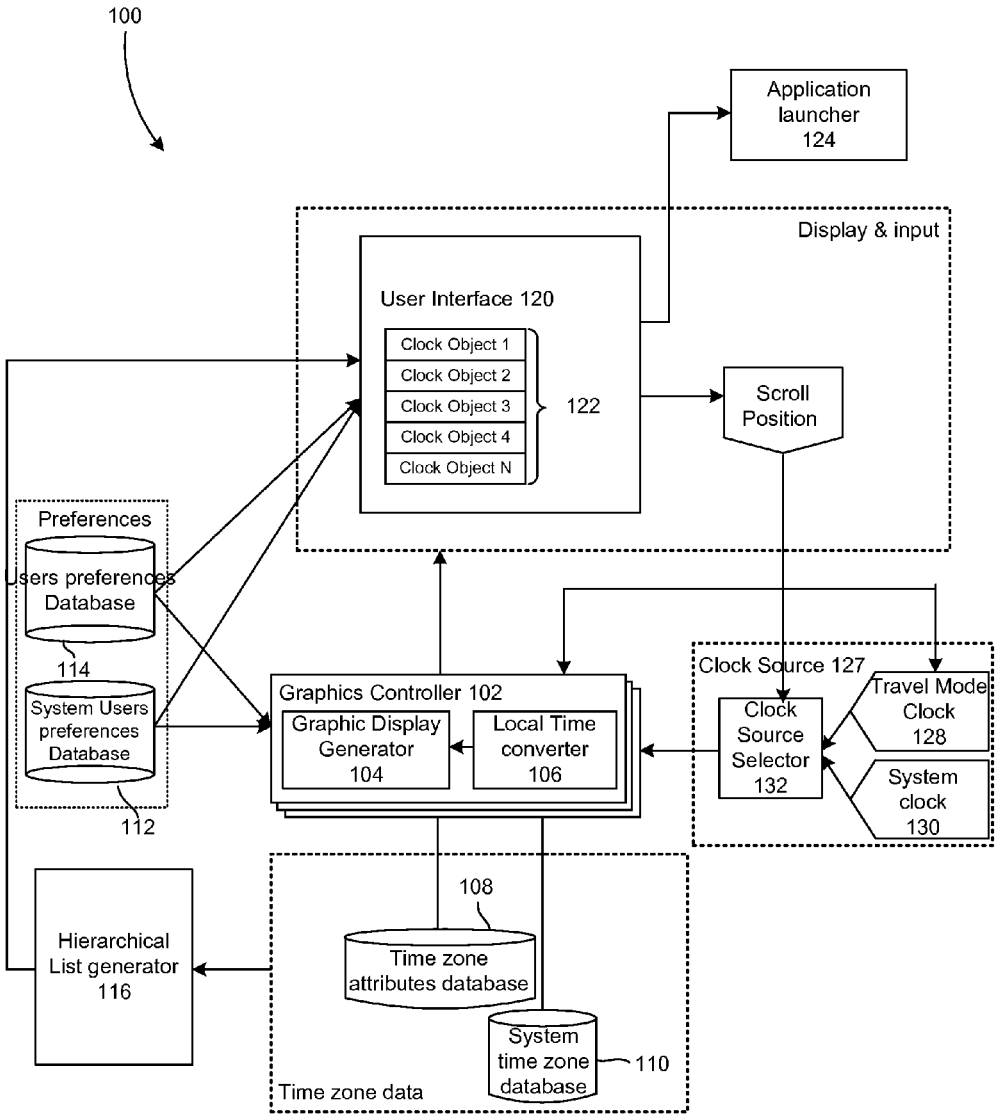
FIG. 1A is a block diagram illustrating example components of a data processing apparatus.

FIG. 1A is a block diagram illustrating example components of a data processing apparatus 100 having a graphics controller 102 for generating and then displaying clock objects 122. The data processing apparatus 100 may include any type of computing device having at least one memory storage and at least one processor. By way of non-limiting example, then, the computing device may include a laptop or desktop computer, a netbook, a tablet computer, a smartphone, a camera, or any device which may process data using one or more processors and memory storages. The underlying hardware components of the data processing apparatus 100 are illustrated with reference to FIG. 5. As explained later in the disclosure, the underlying hardware components may include a memory storage that stores executable instructions that, when executed, cause one or more processors of the data processing apparatus 100 to implement one or more of the following components.

The graphics controller 102 may generate the clock objects 122 for a subset of selected time zones based on time zone data provided by a time zone attributes database 108 and a system time zone database 110, user preferences provided by a system users preferences database 112 and a user preferences database 114, and a clock source 127 that indicates either a travel mode time 128 or a system time 130. The graphics controller 102 may output the clock objects 122 to a user interface 120 for display. Each clock object 122 may be a graphical representation of a different time zone among a selected set of time zones, which is further described with reference to FIG. 1B.

The users preferences database 114 may store database entries including the user's selected time zones for display, corresponding system time zone information (e.g., system time zone IDs for the selected time zones), and display preferences such as a user-defined display name for a time zone. Each system zone ID may be information identifying a particular time zone.

The system users preferences database 112 may store database entries including general display preferences (e.g., display time in 12 hour or 24 hour format) and a current system time zone ID (e.g., the time zone which the user is currently located), which may be automatically selected (e.g., by a mobile network operator), or manually selected by the user. User interfaces having the 12-hour and 24-hour formats are further described with reference to FIG. 1D. Although the system users preferences database 112 and the users preferences database 114 are illustrated as separate databases, the present disclosure contemplates any number of databases including one database for storing user preferences. Also, besides the specific type of user preferences described in this disclosure, the user preferences database may store any other type of user preferences known to one of ordinary skill in the art.

When determining which time zones to select for creating the clock objects 122, the graphics controller 102 may obtain the selected time zones from the users preferences database 114. Alternatively, the graphics controller 102 may obtain the selected time zones by selecting a set of default time zones if the users preferences database 114 does not contain a set of user selected time zones.

The system time zone database 110 may store database entries which associate the system time zone IDs with local time offsets from Universal Coordinated Time (UTC), dates and times in UTC of when Daylight Saving Time (DST) becomes active or inactive, and the amount of DST offset, for every time zone. In other words, the system time zone database 110 stores time zone data for every time zone that is available on the data processing apparatus 100.

The time zone attributes database 108 may store database entries which associate the system time zone IDs with display names and display details for every time zone. In one particular example, the display details may be "Los Angeles UTC-8:00 Pacific Standard Time (DST)", which indicates that the display name is Los Angeles, which is in Pacific Standard Time having the UTC time of UTC-8:00 subject to DST. Although the system time zone database 110 and the time zone attributes database 108 are illustrated as separate databases, the present disclosure contemplates any number of databases for storing this type of information including one database. Also, one or more of the databases 108, 110, 112 and 114 may be local databases or remote data sources (e.g., the internet).

The graphics controller 102 may calculate the current local time, the day name, the month name and/or the day of the month using the time zone data from the system time zone database 110 and determine the display name using the time zone data from the time zone attributes database 108, as further described below.

The clock source 127 includes a clock source selector 132 that selects one of the travel mode time 128 and the system time 130 based on the scroll position provided by the user interface 120. Generally, the graphics controller 102 may operate in one of a current time mode and a travel time mode. Initially, the graphics controller 102 operates in the current time mode because the user has not shifted the current time. As such, if the scroll position indicates the initial position, the clock source selector 132 selects the system time 130, which provides the current UTC time. However, if the user shifts the current time to a future or past time, the graphics controller 102 operates in the time travel mode. In other words, if the scroll position indicates a subsequent scroll position, the clock source selector 132 may select the travel mode time 128, which represents the effective UTC time synthesized from the user's movement.

The graphics controller 102 may include a local time converter 106 that converts one of the system time 130 and the travel mode time 128 into a local time for each selected time zones, and a graphic display generator 104 that generates the clock objects 122 according to either the system time 130 or the travel mode time 128. The local time converter 106 converts the UTC system time or the UTC travel mode time into a local time for each of the selected time zones using the time zone data from the system time zone database 110. For example, the local time converter 106 may convert the UTC time into the local times by applying the appropriate local time offsets while taking into account any DST offsets. In addition, the local time converter 106 may calculate the day name (e.g., Monday, Tuesday, Wednesday), the month name (e.g., January, February, etc.) and/or day of the month (e.g., 1, 2, 3, etc.) using the system time zone data from the system time zone database 110.

The graphic display generator 104 generates the clock objects 122 based on the local times from the local time converter 106, the display details from the time zone attributes database 108 and the user preferences from the users preferences database 114 and/or the system users preferences database 112. For example, the graphic display generator 104 may generate the visual graphical indicators (as further shown in FIG. 1B) and the background colors for the selected time zones using the converted local times. As such, each clock object 122 may include the visual graphical indicator, the background color, the display name, the local time, the day name, the month name, the day of the month, among others, for example.

The visual graphical indicator may be a representation of the sun or the moon. As such, depending on the time of the day provided by the converted local time, the graphic display generator 104 may generate either a representation of the sun or a representation of the moon. Further, each visual graphical indicator may be located at a particular position within each clock object 122. The position of the visual graphical indicator depends on the converted local time. For example, if the converted local time indicates 5:30 am, the visual graphical indicator may be the moon, which is positioned closer to the left side of the clock object 122. Furthermore, the background colors of the clock objects 122 may change according to the converted local times. For example, the graphic display generator 104 may obtain a particular color to be used as the background color depending on the converted local time. In one embodiment, darker colors are associated with evening times, whereas later colors are associated with daylight times. These features are optional, and are further described below.

The user interface 120 receives the clock objects 122 generated by the graphics controller 102 and displays an arrangement of the clock objects 122. The user interface 120 may be a touchscreen, display screen, or any other type of device that interacts with the user. The clock objects 122 may include a first clock object 122-1 to last clock object 122-N, where N may be any integer greater than or equal to two. As shown in FIG. 1A, each clock object 122 corresponds to a different time zone of the selected time zones. Also, each clock object 122 may be a horizontal rectangle, and the horizontal rectangles may be arranged as vertically adjacent rows on the user interface 120. However, the present disclosure contemplated any type of geometric shape for the clock objects 122.

Initially, each clock object 122 may provide the current local time based on the system time 130. However, the user interface 120 may subsequently receive a command from the user shifting the current time to the travel mode time 128. Depending on the specific embodiment of the data processing apparatus 100, the user interface 120 may receive the user command according to a number of different ways. In one particular example, in the case that the user interface 120 includes a touch screen, the user interface 120 may receive information indicating a gesture from the user on the touch screen itself. For example, the user interface 120 may receive information that the user has moved his/her finger across the user interface 120 encompassing the clock objects 122 (e.g., to the left), which may indicate that the user wishes to view the local time in each of the selected time zones for a certain future time. Alternatively, the user interface 120 may receive information that the user has moved his/her finger across the user interface 120 encompassing the clock objects 122 (e.g., to the right), which may indicate the user wishes to view the local time in each of the selected time zones for a certain past time. Also, in the case of a personal computer having a display screen and a pointing device, the user interface 120 may receive information indicating an action by the user using the pointing device and optionally actuating a button associated with the pointing device. If the user interface 120 receives such a user command, the user interface 120 outputs a scroll position indicating the position of the user's movement, which is reflective of the travel mode time 128. Furthermore, according to another embodiment, each clock object 122 may not initially provide the current local time. Also, the graphics controller 102/user interface 120 may receive a command shifting to the travel mode time 128 from an application such as a calendar application or any other type of application.

The graphics controller 102 may update the clock objects 122 according to the user command. For example, the graphics controller 102 may calculate an updated local time corresponding to the travel mode time 128 for each of the selected time zones. The clock source selector 132 receives the scroll position of the user's input and selects the travel mode time 128. The local time converter 106 may convert the UTC travel mode time 128 into the updated local times for each of the selected time zones using the system time zone database 110. Also, the local time converter 106 may update the day name, the month name and/or the day of the month, from the time zone data of the system time zone database 110 for the affected time zones.

The graphics controller 102 may adjust the visual graphical indicator according to the updated local times for each of the selected time zones. For example, using the updated local times, the graphic display generator 104 obtains or re-computes each visual graphical indicator. In one example, the graphic display generator 104 may adjust the position of the sun or the moon and/or switch the sun with the moon (or vice versa). Furthermore, the graphics controller 102 may adjust the background color of the clock objects 122 using the updated local times.

In one embodiment, the user may wish to edit the selected time zones. The user interface 120 may provide an arrangement of the plurality of all available time zones in order to permit the user to edit the subset of selected time zones. In on example, all available time zones are presented to the user in two primary hierarchical categories—time zone category (which arranges the time zones by GMT offsets) and a world region category (which arranges the times zones according to their geographical location). For example, a hierarchical list generator 116 may generate a hierarchical list of the plurality of available time zones. The hierarchical list arranges the plurality of available time zones in a tree structure having a plurality of levels. The tree structure is presented as a sequence of menus in the user interface 120. The top level of the tree structure provides the time zone category and the world region category, and each subsequent level in the tree structure is another menu selection in the user interface 120 that further refines the previous level. These features are described later in the disclosure with reference to FIGS. 4A-4B. According to another embodiment, the user may edit the selected time zones by choosing a location on a graphical world map. For example, when receiving a command to edit the selected time zones, the data processing apparatus 100 may provide a graphical world map. The data processing apparatus 100 may receive a time zone selection via the user's interaction with the graphical world map. For instance, the user may select a certain displayed city, state, country, and/or region via the interactive world map Further, the data processing apparatus 100 may also include an application launcher 124 that is configured to launch an application associated with the data processing apparatus 100 based on a secondary command from the user. For example, in the case the user wishes to schedule a meeting across multiple time zones, the user may adjust the current time to the travel mode time 128 using the user interface 120, while viewing the changing local times in each of the selected time zones. Once the user has selected a suitable time for the parties involved in the conference call, the user interface 120 may receive a subsequent command, which then prompts the application launcher 124 to launch a calendar application. For example, the user interface 120 may include an option such as "create a calendar entry," for example. If the user selects such an option, the application launcher 124 may be configured to launch the calendar application, and populate a calendar entry with the selected time.

In another embodiment, the user of the data processing apparatus 100 may have a user account associated with a geographical-aware application. For example, the geographical-aware application may permit a mobile phone user to allow certain people to view their current location. For privacy, it can also be turned off by the user, or a location can be manually entered. As such, the user account of the user associated with the geographical-aware application may include the locations of a number of different people, who have authorized reporting of their locations.

Therefore, according to one embodiment, the graphics controller 102 may generate one or more clock objects 122 to include the names of the people who are linked to the user account of the geographical-aware application. For example, a person linked to the user account of the geographical-aware application may be currently located in a time zone among the selected time zones. In this example, the graphics controller 102 may be configured to include the name of the linked person in the appropriate clock object 122. In addition, the graphics controller 102 may be configured to select the time zones corresponding to the reported locations, and then generate clock objects 122 corresponding to the time zones of the reported locations. According to another embodiment, the user interface 120 may include an option to either place a telephone call or send a text message to one of names populated in the clock objects 122. For example, the application launcher may be configured to launch a voice application or a text message application when the user interface 120 receives such a command. These features are further explained with reference to FIG. 1E.

Figure 1B:
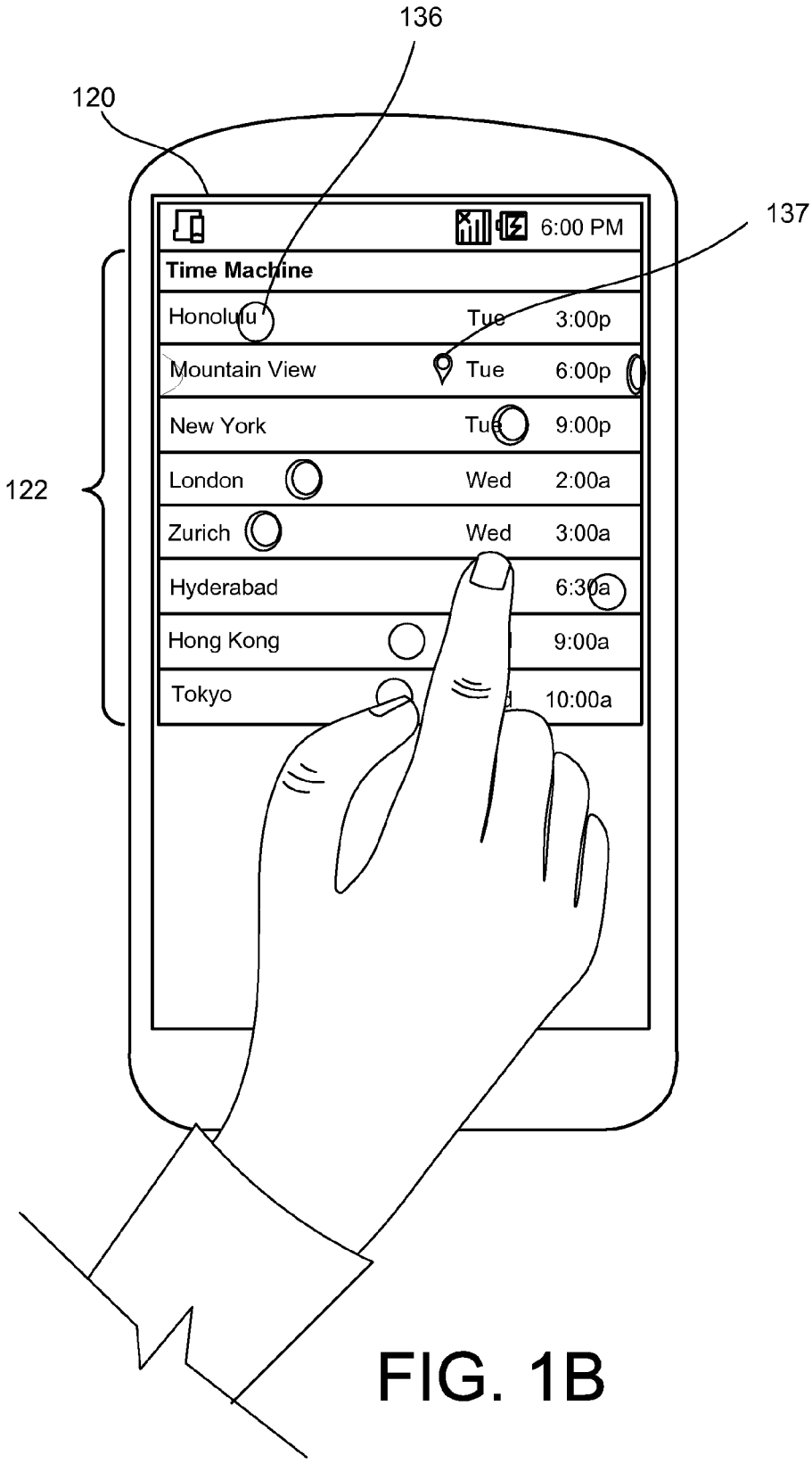
FIG. 1B illustrates a user interface of the data processing apparatus of FIG. 1A according to an embodiment.

FIG. 1B illustrates the user interface 120 of the data processing apparatus 100 according to an embodiment. As shown in FIG. 1B, each clock object 122 corresponds to a different time zone of the selected time zones. In this case, the selected time zones are Honolulu, Mountain View, New York, London, Zurich, Hyderabad, Hong Kong, and Tokyo.

Although clock object 122 is illustrated as a horizontal strip or rectangle, the present disclosure contemplates any type of graphical representation including a circle, square or any other geometric shape. As shown in FIG. 1B, each clock object 122 includes 1) the name of the time zone (e.g., Honolulu, Mountain View, New York, etc.), 2) the day of the week (Tue, Wed, etc.) corresponding to the current local time, 3) the current local time in its respective time zone, and 4) a visual graphical indicator 136. As indicated above, the visual graphical indicator 136 may a representation of the sun or the moon. For simplicity, the figures illustrate the sun representation as a circle, and the moon representation as a circle within a circle. However, the sun representation and the moon representation encompass additional graphical features as well as coloring information, which are described later.

At least one clock object 122 includes a time zone indicator 137 that indicates the user's current time zone. For example, in FIG. 1B, the time zone indicator 137 indicates that the user is currently located in the Mountain View time zone. Information about the user's current time zone may be obtained from a Global Positioning System (GPS) on the data processing apparatus 100, or entered manually from the user. Further, the user's current time zone may be selected by a mobile network operator.

As indicated above, the visual graphical indicator 136 may be the sun representation (e.g., the sun representation is shown for Honolulu, Mountain View, Hyderabad, Hong Kong and Tokyo) or the moon representation (e.g., the moon representation is shown for New York, London, and Zurich). In one embodiment, if the current local time falls within the time period of 6 am to 6 pm, the graphic display generator 104 generates the visual graphical indicator 136 as the sun representation. Also, if the current local time falls within the time period of 6 pm to 6 am, the graphic display generator 104 generates the visual graphical indicator 136 as the moon representation. The daylight period of 6 am to 6 pm and the nighttime period of 6 pm to 6 am are used for explanatory purposes only, where the present disclosure contemplates any variation of the times used for displaying the sun or the moon.

The position of the visual graphical indicator 136 within each clock object 122 is dependent upon the converted local time. For example, in one embodiment, the display of the clock objects 122 may be in a 12-hour format or a 24-hour format. In the particular example of FIG. 1B, the display of the clock objects 122 is within the 12-hour display. As such, with respect to the clock object 122 corresponding to Mountain View, the current local time is 6:00 pm. Because the time 6:00 pm indicates the end of daylight hours, the sun representation is located toward the right edge of the clock object 122. Also, with respect to the clock object 122 corresponding to Hyderabad, the current local time is 6:30 am. Because the time 6:30 am indicates the beginning of daylight hours, the sun representation is located toward the left edge of the clock object 122. Similarly, with respect to the clock object 122 corresponding to Zurich, the current local time is 3:00 am. Because 3:00 am is relatively close to the end of the nighttime period (6 am), the moon representation is relatively closer to the left edge of the clock object 122. As a result, the type of visual graphical indicator (e.g., sun or moon), as well as its position, gives the user visual cues for the time of the day in order to made scheduling events relatively easier.

Also, as indicated above, each clock object 122 includes the day name (e.g., Tue, Wed, etc.). The day name provides the user with another visual cue so as to easily determine whether a desired time falls within the same day or across multiple days for multiple time zones. Also, if the user wishes to schedule a meeting during business days, the user can easily view whether a particular time falls on a week day or on a weekend.

Unlike the name of the time zone, the day name, and the local time (as well as the month name and day of the month), the position of the visual graphical indicator 136 moves in relation to its local time. In this example, as the user's finger moves across the user interface 120, the graphics controller 102 updates the current local time and the visual graphical indicator 136 for each the clock objects 122 for the selected time zones. If the movement is to the left, the graphics controller 102 updates the local time, the position of the visual graphical indicator 136, as well as possibly the type of visual graphical indicator 136 and day name (also month name and day of the month) for each clock object 122. The left movement may indicate that the user wishes to find a future time, and a movement to the right may indicate that the user wishes to find a past time. In other words, as the user's finger moves across the user interface 120, the graphics controller 102 is configured to updated the plurality of clock objects 122 over a period of time (e.g., updates every 1, 5, 10, 15, 30, 60 minutes, ect). As such, as the user's finger moves across the user interface 120, the user may view the changing local times in each of the clock objects 122.

In one embodiment, the graphics controller 102 may update the clock objects 122 according to snap intervals. For example, if the period of time includes a plurality of time intervals, the graphics controller 102 may update the clock objects 122 such that the local time is updated and the visual graphical indicator 136 is adjusted at each time interval according to the travel mode time at a respective time interval. For instance, each time interval (also known as snap intervals) may be 10 minutes, 15 minutes, 30 minutes or 60 minutes. Also, the user may have the option of turning off the snap interval, which the graphics controller 102 updates the clock objects 122 every minute (or perhaps seconds if seconds are shown on the display).

Figure 1C:
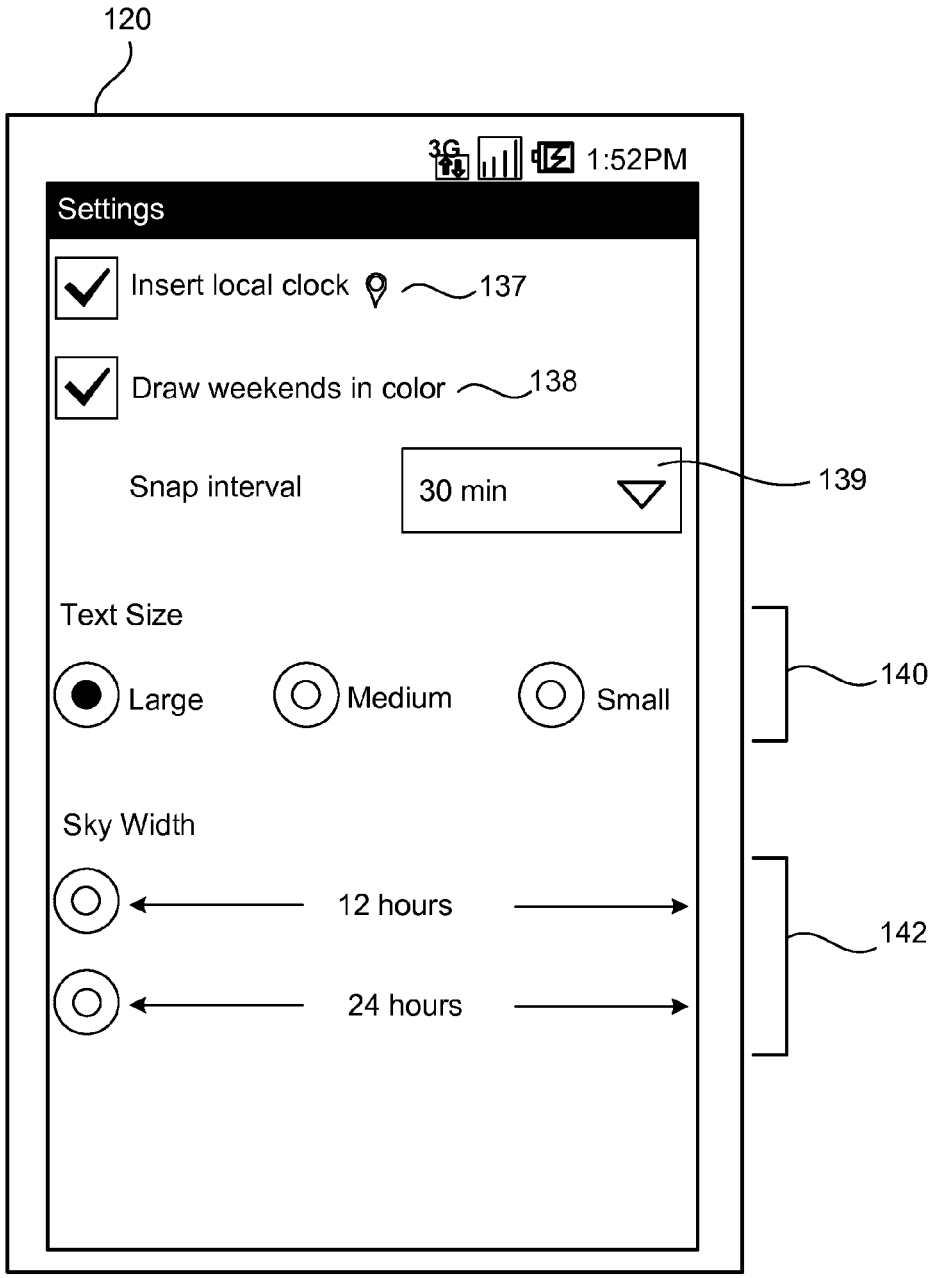
FIG. 1C illustrates a user interface of the data processing apparatus of FIG. 1A according to another embodiment.

FIG. 1C illustrates the user interface 120 of the data processing apparatus 100 according to another embodiment. The user interface 120 of FIG. 1C illustrates selectable options for displaying the clock objects 122. For example, the user interface 120 may include a local clock insertion option 137, a color weekends option 138, a snap interval option 139, a text size option 140 and a sky width option 142. For example, the local clock insertion option 137 provides the user with the option of inserting the time zone indictor 137. Also, the time zone indicator 137 may automatically change to a different clock object 122 if the user moves into a different time zone. If the user selects this option, the graphics controller 102 includes the time zone indicator 137 for the appropriate clock object 122. The color weekends option 138 provides the user with the option of drawing the weekends in color on the clock objects 122 so as to distinguish between work days. For example, on Saturday and Sunday, the graphic display generator 104 may provide the clock name, day name, and time of day text with a color tint such as orange. The snap interval option 139 provides the option of choosing which snap interval the user prefers, as explained above. The text size option 140 provides the option of choosing between a large text size, a medium text size and small text size. However, the present disclosure contemplates any type of characterization regarding the size of the text. The sky width option 142 provides the options of choosing between the 12-hour format and the 24-hour format, as explained in more detail below with respect to FIG. 1D. It is noted that the present disclosure encompasses any other type of display preferences known to one of ordinary skill in the art. The system users preferences database 112 may be configured to store the above-identified display preferences, as well as other types of display preferences known to one of ordinary skill in the art.

Figure 1D:
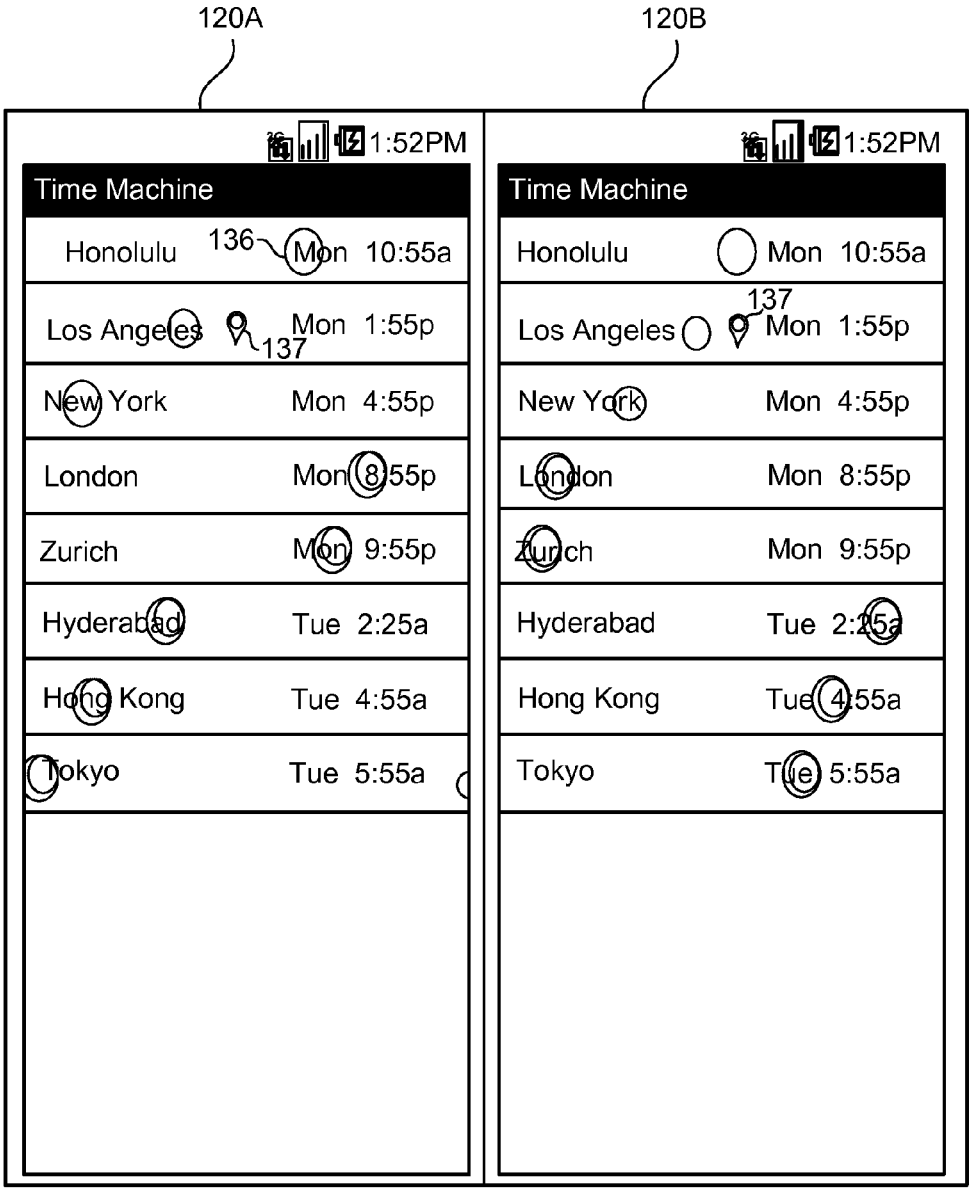
FIG. 1D illustrates a user interface in a 12-hour format and a user interface in a 24-hour format of the data processing apparatus of FIG. 1A according an embodiment.

FIG. 1D illustrates a user interface 120A in a 12-hour format and a user interface 120B in a 24-hour format according an embodiment. With respect to the user interface 120A, the width of the clock object 122 represents a 12-hour time span. Both the sun representation and the moon representation traverse the full width. The left and right edges of the clock objects 122 are both 6:00 am and 6:00 pm, and the center of the clock objects 122 is both midnight and noon. With respect to the user interface 120B, the width of the clock objects 122 represents a 24-hour time span. The sun representation traverses the central part of the clock objects 122, and the moon representation traverses the right and left edges. Both the left and right edges of clock objects 122 are midnight, and the center of the clock objects 122 is noon.

Figure 1E:
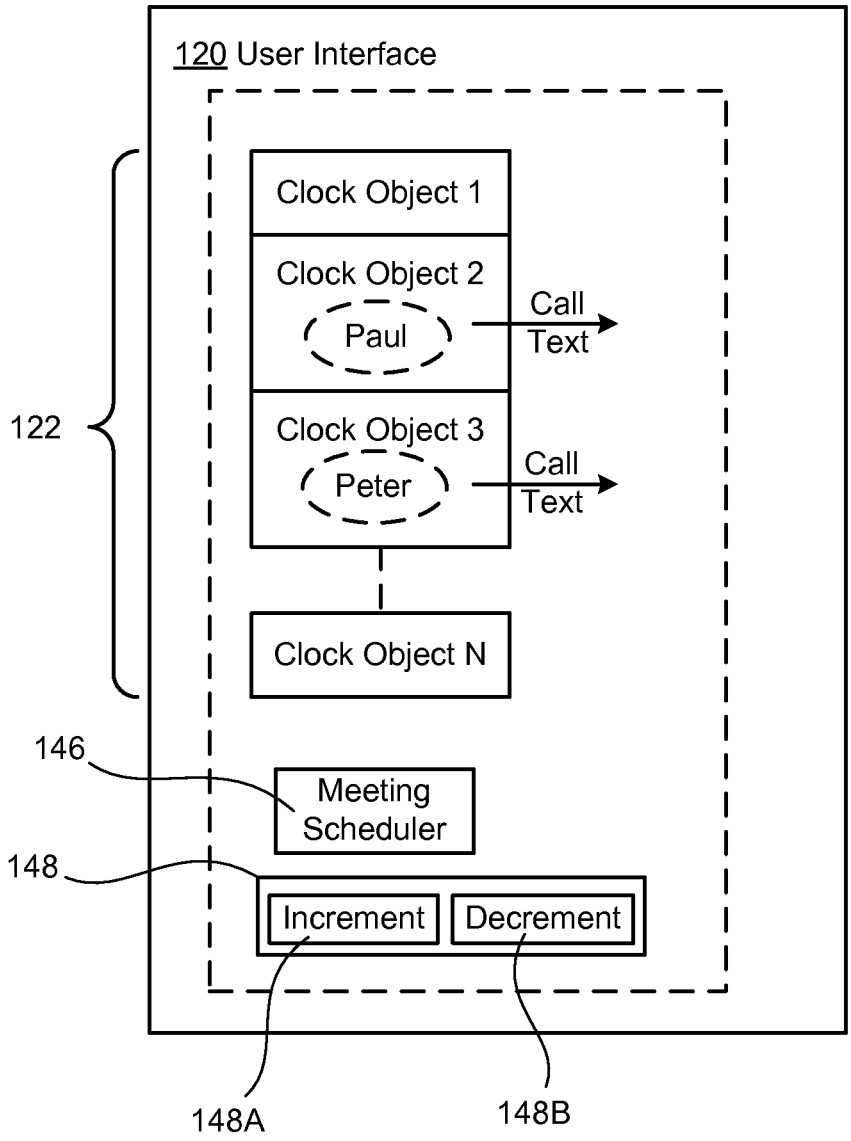
FIG. 1E illustrates a user interface of the data processing apparatus of FIG. 1A according to another embodiment.

FIG. 1E illustrates the user interface 120 according to another embodiment. In this example, at least some of the clock objects 122 include a name of a person associated with a particular time zone. In the example of FIG. 1E, Paul is currently located in time zone 2, and Peter is currently located in time zone 3. Paul and Peter may be linked to a user account of the user, and may have permitted their locations to be reported via the geographical-aware application, as explained above. As such, the graphics controller 102 may generate clock object 122-2 and clock object 122-3 to include Paul and Peter so that the user can easily view which person is associated with a particular time zone. Further, the user interface 120 may receive a secondary command (e.g., moving the name "Paul" to the right), which prompts the application launcher 124 to launch one of a text message application and voice application. Further, the application launcher 124 may populate either the text message or the voice call with the appropriate information such as the telephone number, and, in the case of a voice call, may directly call the person.

Further, the user interface 120 may have a meeting scheduler 146. For example, the user may scrub the user interface 120 in the manner described above until the user has located a suitable time to schedule a meeting between the user, Paul and Peter. Thereafter, the user interface 120 may receive a secondary command (e.g., touching the meeting scheduler button), which prompts the application launcher 124 to launch a calendar application. The application launcher 124 may populate a calendar entry of the calendar application with the chosen time, and, optionally, with the contact information of Paul and Peter.

Also, the user interface 120 may include a user control 148 that allows the user to adjust the local time (e.g., by the minute). The user control 148 may include an incrementing option 148A and a decrementing option 148B. For example, as explained above, the user may scrub the user interface 120 according to the selected snap interval of 10, 15, 30 and 60 minutes. However, the incrementing option 148A and the decrementing option 148B provide the user with a more accurate control. For example, if the user has selected the 10 minute snap interval, the user may use the incrementing option 148A and the decrementing option 148B to change the local time by the minute. However, the present disclosure contemplates any type of user control 148 that permits the user to adjust the values of the local time.

Figure 2A:
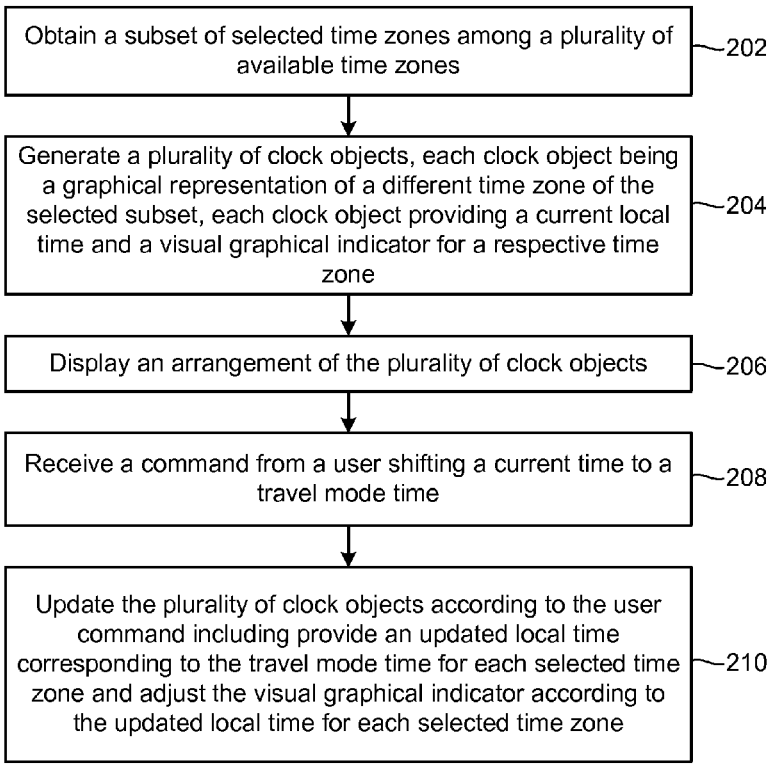
FIG. 2A is a flowchart illustrating example operations of the data processing apparatus of FIG. 1A according to an embodiment.

FIG. 2A is a flowchart illustrating example operations 202-210 of the data processing apparatus 100 of FIG. 1A. Although the flowchart of FIG. 2A illustrates the operations 202-210 in sequential order, it will be appreciated that this is merely an example, and that additional or alternative operations may be included. Further, operations of FIG. 2A and related operations may be executed in a different order than that shown, or in a parallel or overlapping fashion.

A subset of selected time zones among a plurality of available time zones may be obtained (202). For example, the graphics controller 102 may obtain the selected time zones from the users preferences database 114. Also, the graphics controller 102 may obtain the selected time zones by selecting default time zones. For example, the user may not have chosen a set of time zones. In such a case, the graphics controller 102 may select a certain number of default time zones. Further, the graphics controller 102 may select one or more time zones from the users preferences database 114 and select one or more default times.

A plurality of clock objects may be generated (204). For example, the graphics controller 102 may initially generate the plurality of clock objects 122 corresponding to the selected time zones or default list of selected time zones. The clock source selector 132 may receive information from the user interface 120 indicating that the scroll position has not moved, and then select the system time 130, which represents the current time in UTC. The local time converter 106 may convert the system time into a local time for each of the selected time zones using the time zone data from the system time zone database 110. Further, the local time converter 106 may determine the day name associated with each local time using the time zone data from the system time zone database 110. The graphic display generator 104 may generate the visual graphical indictor 136 and background color for each selected time zones according to its respective converted local time, and provide the local time, the visual graphical indicator 136, the day name, and/or the display name (as well as any other type of information such as the month name and day of the month) for each selected time zone according to the time zone data in the time zone attributes database 108 and the user preferences in the users preferences database 114 and/or system users preferences database 112.

The clock objects may be displayed (206). For example, the user interface 120 may receive the clock objects 122 generated from the graphics controller 102, and display an arrangement of the clock objects 122. Each clock object 122 may be a horizontal rectangle, and the horizontal rectangles may be arranged as vertically adjacent rows on the user interface 120. However, the present disclosure contemplates any type of geometric shape for the clock objects 122.

A command shifting to a travel mode time may be received (208). For example, the user may scrub the user interface 120 in order to search for future or past times. In this case, the command may be received from a user shifting the current time to a travel mode time. In one example, the user interface 120 may be configured to receive information indicating a gesture from the user on the user interface 120. For instance, in the case that the user interface 120 includes a touch screen, the user interface 120 may receive a gesture on the user interface 120 itself. In one example, the user interface 120 may receive information that the user has moved his/her finger across the user interface 120 encompassing the clock objects 122 (e.g., to the left), which may indicate that the user wishes to view the local time in each of the selected time zones for a certain future time. Alternatively, the user interface 120 may receive information that the user has moved his/her finger across the user interface 120 encompassing the clock objects 122 (e.g., to the right), which may indicate the user wishes to view the local time in each of the selected time zones for a certain past time. Also, in the case of a personal computer having a display screen and a pointing device, the user interface 120 may receive information indicating an action by the user using the pointing device. Alternatively, the command may be received from an application such as a calendar application (or any other type of application), in which the command shifts to the travel mode time. For example, a user may be operating the calendar application by browsing future times. Upon selection of a future time, the graphics controllers 102 may receive the command from the calendar application that shifts to the travel mode time.

In addition, the user interface 120 may include the incrementing selection 148A and the decrementing selection 148B (as shown on FIG. 1E), which, when pressed, allows the user to control the selection of travel mode times. When the user interface 120 receives these types of user commands, the user interface 120 outputs a scroll position indicating the position of the user's movement, which is reflective of the travel mode time 128.

The plurality of clock objects may be updated such that an updated local time is provided according to the travel mode time for each selected time zone and the visual graphical indicator is adjusted according to the updated local time for each selected time zone (210). For example, the graphics controller 102 may calculate an updated local time corresponding to the travel mode time 128 for each of the selected time zones. For example, the clock source selector 132 receives the scroll position of the user's input and selects the travel mode time 128. The local time converter 106 converts the UTC travel mode time 128 into the updated local times for each of the selected time zones using the system time zone database 110. Also, the local time converter 106 updates the day name from the time zone data of the system time zone database for the affected time zones. The graphics controller 102 may adjust the visual graphical indicator according to the updated local times for each of the selected time zones. For example, using the updated local times, the graphic display generator 104 obtains or re-computes the visual graphical indicator. The graphic display generator 104 may adjust the position of the sun or the moon and/or switch the sun with the moon (or vice versa). Furthermore, the graphics controller 102 may adjust the background color of the clock objects 122 using the updated local times.

Figure 2B:
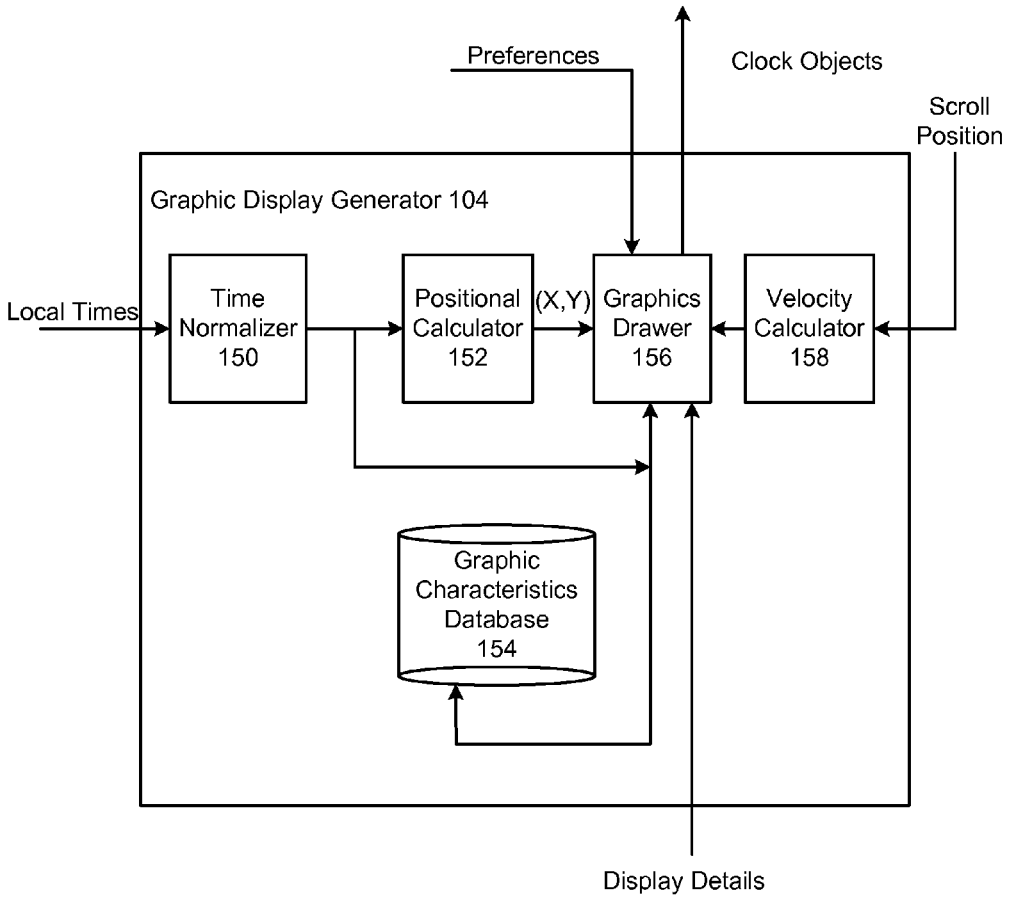
FIG. 2B illustrates a graphic display generator of the data processing apparatus of FIG. 1A according to an embodiment.

FIG. 2B illustrates the graphic display generator 104 of the graphics controller 102 according to an embodiment. As explained above, referring to FIG. 1A, the clock source selector 132 selects one of the travel mode time 128 and the system time 130 depending on the scroll position received from the user interface 120. Subsequently, the local time converter 106 converts either the travel mode time 128 or the system time 130 into a local time for each of the selected time zones using the time zone data from the system time zone database 110. Then, the graphic display generator 104 is configured to receive the local time for each of the selected time zones, and generate the clock objects 122, as further described below.

The graphic display generator 104 may include a time normalizer 150, a positional calculator 152, a graphic characteristics database 154, a graphics drawer 156, and a velocity calculator 158. The time normalizer 150 may receive the converted local times from the local time converter 106, and may normalize each local time to a value. The values may be integers, floating point values, or any other type of value that represents time. The values may be used to selected color characteristics from the graphic characteristics database 154.

The graphic characteristics database 154 may include a color look-up table. The color look-up table may include columns corresponding to the values and rows corresponding to different graphic characteristics (e.g., the background image, the visual graphical indicators 136). When generating the background images and the visual graphical indicators 136 for the selected time zones, the graphics drawer 156 may obtain the appropriate color for these elements based on the graphic characteristics database 154 using the values. For instance, according to one embodiment, the graphics drawer 156 may continuously re-draw the visual graphical indicators 136 as the time changes in the time travel mode. Alternatively, the graphic display generator 104 may be implemented without the use of the color look-up table. For example, the graphics drawer 156 may obtain pre-computed visual graphical indicators 136. In this alternative case, the graphic characteristics database 154 may include the pre-computed visual graphical indicators 136.

The positional calculator 152 may compute the position (X, Y) of the visual graphical indicator 136 relative to the edges of the clock objects 122 for each of the selected time zones based on the integer values.

The graphics drawer 156 may draw the clock objects 122 based on the user preferences from the users preferences database 114 and/or the system users preferences database 112, the display details from the time zone attributes database 108, the normalized integer values, and the calculated positions. Also, as further described below, the graphics drawer 156 may generate different visual graphical indicators 136 depending on the velocity of the user's movement.

With respect to the background images and the visual graphical indicators 136, the graphics drawer 156 may obtain the color information for these elements from the graphic characteristics database 154 using the normalized integer values. Also, the graphics drawer 156 may draw the visual graphical indicator 136 at a position within the clock object 122 provided by the positional calculator 152. The graphics drawer 156 may draw the visual graphical indicator 136, as further described below.

In one embodiment, the sun representation may include a halo and a central orb, which may be rendered in pure white with various amounts of transparency (e.g., alpha<1.0), with a final color applied as a tint when rendered in the clock objects 122. First, the graphics drawer 156 draws the halo as a radial gradient, centered in the graphic, varying from nearly opaque at the center to fully transparent at the periphery. The graphic drawer 156 modifies the radial gradient by adding alpha noise to eliminate banding. Generally, the graphics drawer 156 draws the orb of the sun representation as a white, filled circle.

In one embodiment, the moon representation may also include a halo and a central orb. Basically, the moon colors are fixed when the graphics are created, and the graphics drawer 156 varies the graphic transparency when the graphic is rendered into the clock object 122. First, the graphics drawer 156 may draw the halo as a radial gradient, varying from transparent white in the center to fully transparent at the periphery. The graphics drawer 156 may render the halo with dithering. Generally, the graphics drawer 156 draws the orb of the moon representation as a white, filled circle composited with a dark, offset filled circle (e.g., moon shadow). The graphics drawer 156 modifies the completed graphic by adding value noise to suggest a rough surface.

The graphics drawer 156 may re-draw the clock objects 122 each time a new computation value is provided to the local time converter 106. However, alternatively, the graphics drawer 156 may use pre-computed visual graphical indicators 136. In such a case, the graphics drawer 156 obtains the appropriate pre-computed graphical indicators 136 based on the integer values and places them at the appropriate position provided by the positional calculator 152.

According to one embodiment, the graphics drawer 156 may draw the visual graphical indicators 136 differently depending on the velocity of the user's movement. For example, the velocity calculator 158 may calculate a velocity of adjusting the current time to the travel mode time 128. For example, the velocity calculator 158 receives the scroll position from the user interface 120 and computes the velocity of the user's movement. Depending on the calculated velocity, the graphics drawer 156 may generate the full-size visual graphical indicators 136 as explained above or visual graphical indicators 136 having less graphical elements. In one example, the velocity calculator 158 may express the calculated velocities in an integer range such as 0 to 9.

For example, at velocity=0, with respect to the sun representation, the graphics drawer 156 may draw the full sun and halo graphic as explained above. As the velocity increases, the graphics drawer 156 may use an alternate sun representation with smaller diameter halos. In another embodiment, if the velocity reaches a critical threshold, the graphics drawer 156 may draw only the sun orb with no halo component. With respect to the moon representation, at velocity=0, the graphics drawer 156 may draw the full moon and the halo graphic. As the velocity increases, the graphics drawer 156 may draw an alternative moon, which includes only the orb. Further, with respect to the moon representation, at velocity=0, the graphics drawer 156 may draw both the text and shadow. However, if the velocity reaches a critical threshold, the graphics drawer 156 may omit the shadow.

The graphics drawer 156 may obtain the display name from the time zone attributes database 108. If the display name of the clock object 122 exceeds the available width, the graphics drawer 156 may truncate the display name with ellipses. In addition, the graphics drawer 156 may shift one or more of the day names or other displayed information to improve visual alignment. Further, if the time zone indicator 137 is selected, the graphics drawer 156 may draw the time zone indicator 137 for the appropriate time zone.

Figure 3A:
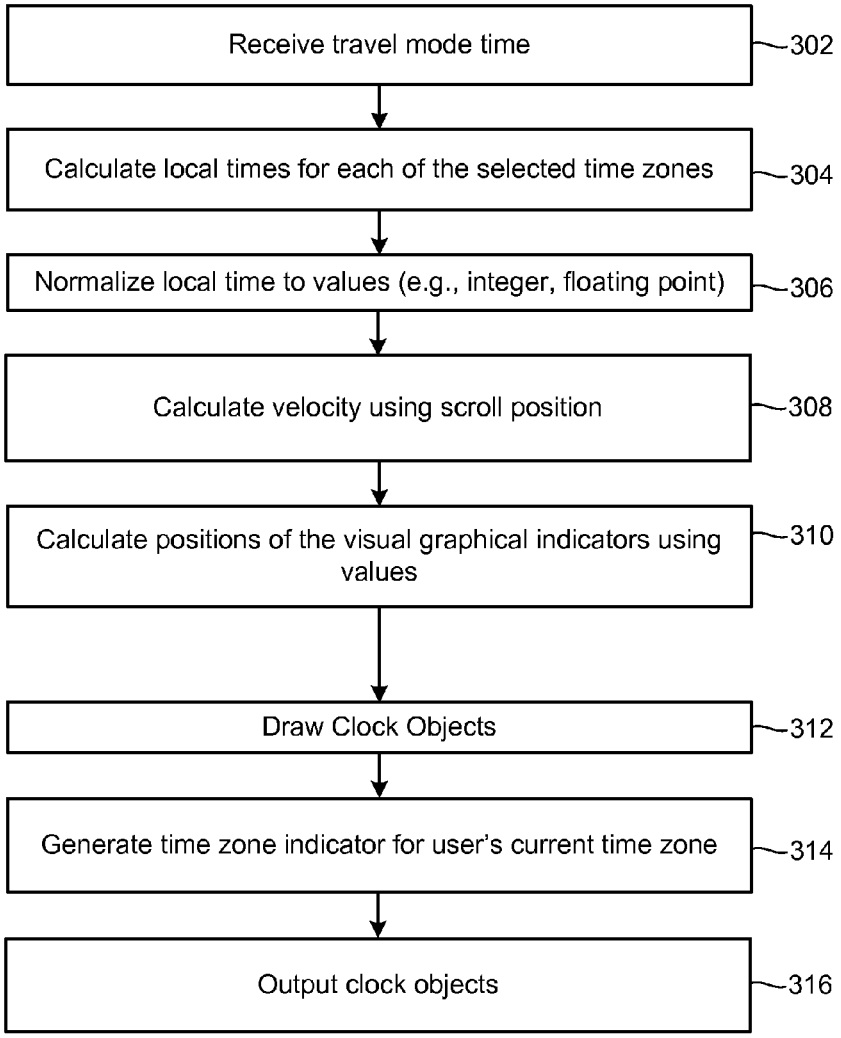
FIG. 3A is a flowchart illustrating example operations of the data processing apparatus of FIG. 1A according to an embodiment.

FIG. 3A is a flowchart illustrating example operations 302-316 of the data processing apparatus 100 of FIG. 1A. Although the flowchart of FIG. 3A illustrates the operations 302-316 in sequential order, it will be appreciated that this is merely an example, and that additional or alternative operations may be included. Further, operations of FIG. 3A and related operations may be executed in a different order than that shown, or in a parallel or overlapping fashion.

A travel mode time may be received (302). For example, the local time converter 106 may receive the travel mode time 128 from the clock source selector 132.

Local times may be calculated for each of the selected time zones (304). For example, the local time converter 106 may convert the UTC travel mode time 128 to a local time for each of the selected time zones based on the time zone data from the system time zone database 110.

Local times may be normalized to integer values (306). For example, the time normalizer 150 may normalize the calculated local times to integer values. The integer values may be in the range of 0 to 999.

Velocity of the user's movement may be calculated based on the scroll position (308). For example, the velocity calculator 158 may receive the scroll position from the user interface 120 and compute the velocity of the user's movement.

Positions of the visual graphical indicators are calculated (310). For example, the positional calculator 152 receives the integer values and computes the positions of the visual graphical indicators 136 relative to the edges of the clock objects 122 for each of the selected time zones using the integer values.

Clock objects are drawn (312). The graphics drawer 156 may draw the clock objects 122 based on the user preferences from the users preferences database 114 and/or the system users preferences database 112, the display details from the time zone attributes database 108, the normalized integer values, the calculated positions, as well as the calculated velocity. In one embodiment, the graphics drawer 156 may re-generate the visual graphical indicators 136. In another embodiment, the graphics drawer 156 may use pre-computed graphical indicators 136 stored in the graphic characteristics database 154. When the visual graphical indicators 136 are re-drawn, with respect to the background images and the visual graphical indicators 136, the graphics drawer 156 may obtain the color information for these elements from the graphic characteristics database 154 using the normalized integer values. The graphics drawer 156 may draw the visual graphical indicator 136 at a position within the clock object 122 provided by the positional calculator 152, and include the appropriate background color provided by graphic characteristics database 154. The graphics drawer 156 may draw the visual graphical indicators 136 differently depending on the velocity of the user's movement. For example, depending on the calculated velocity, the graphics drawer 156 may generate the full-size visual graphical indicators 136 or the reduced-complexity visual graphical indicators 136.

The time zone indicator for the user's current time zone may be generated (314). For example, if the time zone indicator 137 is selected, the graphics drawer 156 may draw the time zone indicator 137 for the appropriate time zone.

Clock objects may be outputted to a user interface for display (316). For example, the graphics drawer 156 may output the clock objects 122 to the user interface 120 for display.

One or more of the components illustrated in FIG. 1A may be downloaded to the data processing apparatus 100 over a network. The network may be the public Internet or other wide area public or private network. Also, the network may be a corporate or other intranet, and/or a smaller-scale, local or personal network, any of which may be implemented using standard network technology.

Figure 3B:
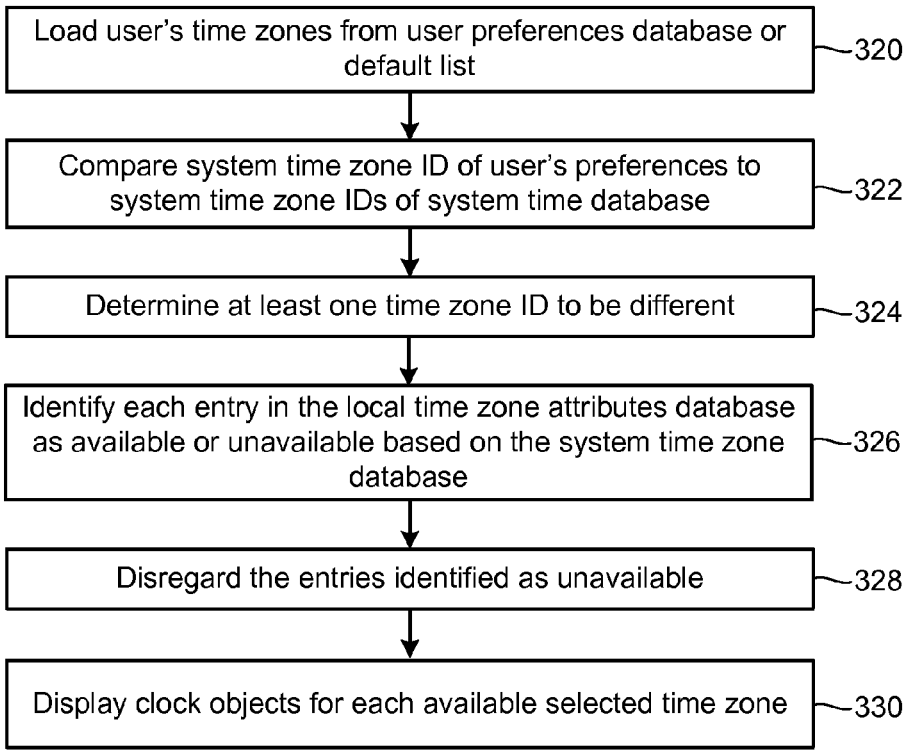
FIG. 3B is a flowchart illustrating example operations of the data processing apparatus of FIG. 1A according to another embodiment.

FIG. 3B is a flowchart illustrating example operations 320-330 of the data processing apparatus 100 of FIG. 1A. Although the flowchart of FIG. 3B illustrates the operations 320-330 in sequential order, it will be appreciated that this is merely an example, and that additional or alternative operations may be included. Further, operations of FIG. 3B and related operations may be executed in a different order than that shown, or in a parallel or overlapping fashion.

Before displaying the clock objects 122, the graphics controller 102 may determine if the selected time zones are available. For instance, the system time zone database 110 includes every time zone provided by the data processing apparatus 100. If the system time zone database 110 does not include a particular time zone, the graphics controller 102 may update the time zone attributes database 108 so as to delete the unavailable time zone. These processes are further explained below.

The user's selected time zones may be loaded or the default list of selected time zones may be loaded (320). For example, the graphics controller 102 may obtain the list of selected time zones from the users preferences database 114. Alternatively, the graphics controller 102 may obtain a default list if the users preferences database 114 does not include the user's selection (e.g., after the initial start-up or the user has deleted them all).

The current system time zone IDs are compared with the system time zone IDs stored in the users preferences database 114 (322). For example, the graphics controller 102 may be configured to compare the current system time zone IDs, which are stored in the system time zone database 110, with the system time zone IDs stored in the users preferences database 114.

At least one system time zone ID may be determined as being different (324). For example, the graphics controller 102 may determine whether at least one of the current system time zone IDs differ from the system time zone IDs stored in the users preferences database 114. If the graphics controller determines that at least one system time zone differs, the process proceeds to step 326.

Each entry in the time zone attributes database 108 is identified as available or unavailable based on the system time zone database 110 (326). For example, the graphics controller 102 is configured to iterate through all entries in the time zone attributes database 108, and identify whether each entry is available or unavailable depending on the existence of the associated system time zone ID in the system time zone database 110. For instance, if a system time zone ID is not contained in the system time zone database 110 for a corresponding entry in the time zone attributes database 108, the graphics controller 102 is configured to identify the entry as unavailable. In contrast, if the system time zone ID is contained in the system time zone database 110 for a corresponding entry in the time zone attributes database 108, the graphics controller 102 is configured to identify the entry as available.

The entries identified as unavailable are disregarded (328). For example, the graphics controller 102 is configured to disregard the unavailable entries from the time zone attributes database 108. As a result, the unavailable entries are not presented to the user.

Clock objects for each available selected time zone are displayed (330). For example, the graphics controller 102 may generate the clock objects 122 for the available selected time zones as described above, and output the clock objects 122 to the user interface 120 for display.

Referring back to FIG. 1A, as described above, the hierarchical list generator 116 generates a hierarchical list of the available time zones. For example, the hierarchical list arranges the available time zones (e.g., determined from the process of FIG. 3B) in a tree structure having a plurality of levels including a top level, where the top level provides a time zone category and a world region category. For instance, if the user wishes to edit the selected times, the user interface 120 may display the plurality of available time zones according to the hierarchical list, where only one level is shown at a time. The menu structure corresponds to the tree structure, which is further explained with reference to FIGS. 4A-4E.

Figure 4A:
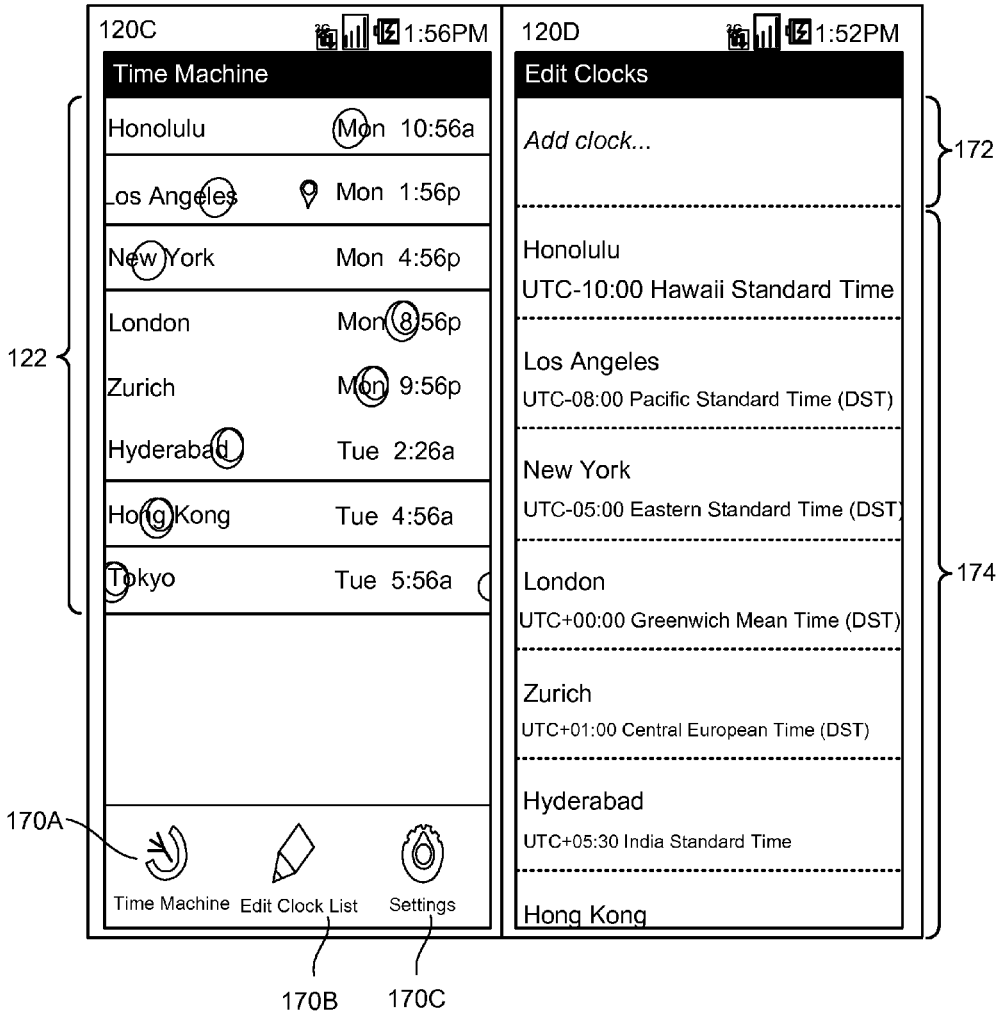
FIGS. 4A-4E illustrates user interfaces of the data processing apparatus of FIG. 1A according to an embodiment.

FIG. 4A illustrates a user interface 120C and a user interface 120D according to an embodiment. The user interface 120C may provide a time machine selection 170A, which launches the user interface 120 of FIG. 1B in order to permit the user to adjust the current time to the travel mode time 128. Also, the user interface 120C may provide an edit clock list option 170B and a settings option 170C that launches the user interface 120 of FIG. 1C. If the user selects the edit clock list selection 170B, the user interface 120D is displayed, which includes an add clock option 172 and a list 174 of the currently selected clock objects 122 having the display details provided by the time zone attributes database 108. If the user selects the add clock option 172, the following user interfaces are displayed.

Figure 4B:
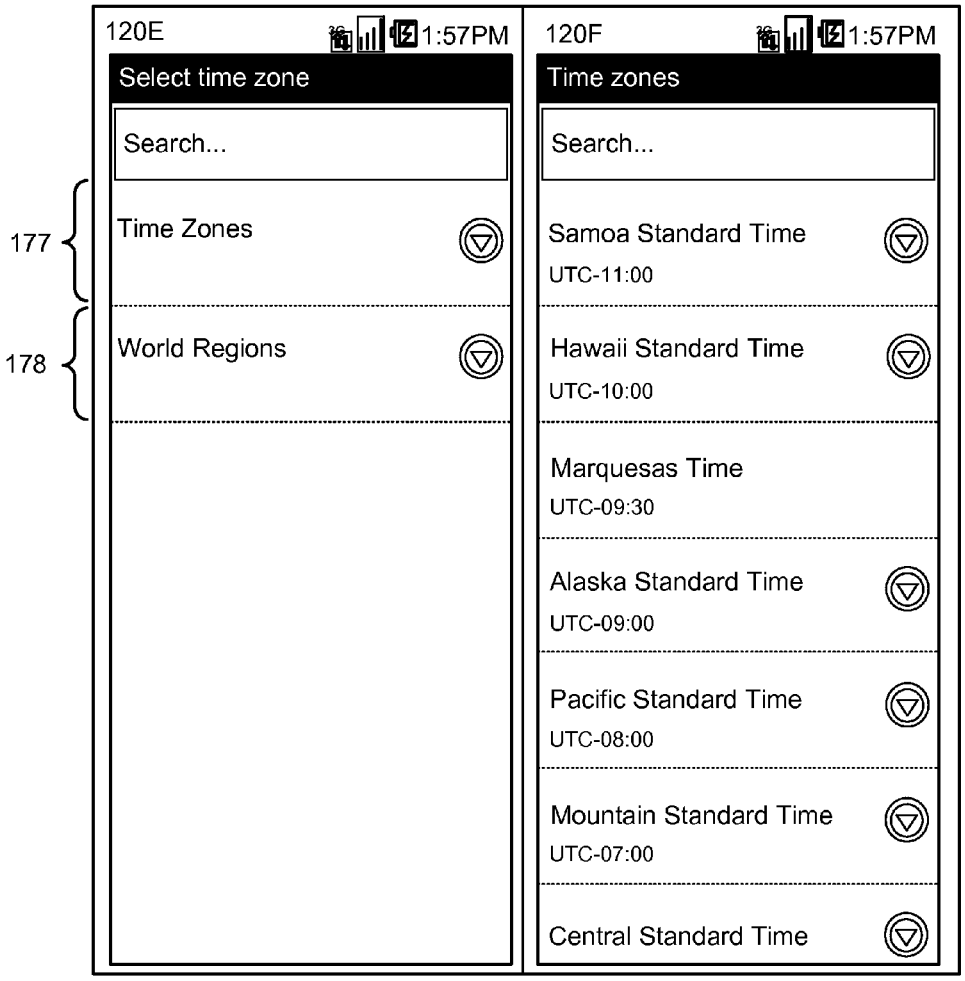

FIG. 4B illustrates a user interface 120E and a user interface 120F according to an embodiment. The user interface 120E provides the top level of the hierarchical list, which includes a time zone category 177 and a world region category 178. Also, the user interfaces of FIGS. 4B-4E provide a search box permitting the user to navigate through the hierarchy list by typing in one or more letters in the search box, and then choose from a brief list of entries containing the letter sequence. If the user selects the time zone category 177, the next level of the hierarchical list is displayed, which is illustrated in user interface 120F. For example, the user interface 120F displays a collection of all time zones from UTC-11:00 (just east of the International Date Line) through UTC+12:00. It is noted that Marquesas Time is an actual time zone, not a collection of time zones. As such, if the user wishes to view the time zones associated with "Central Standard Time", the user selects this option, and is provided with a user interface as further described below.

Figure 4C:
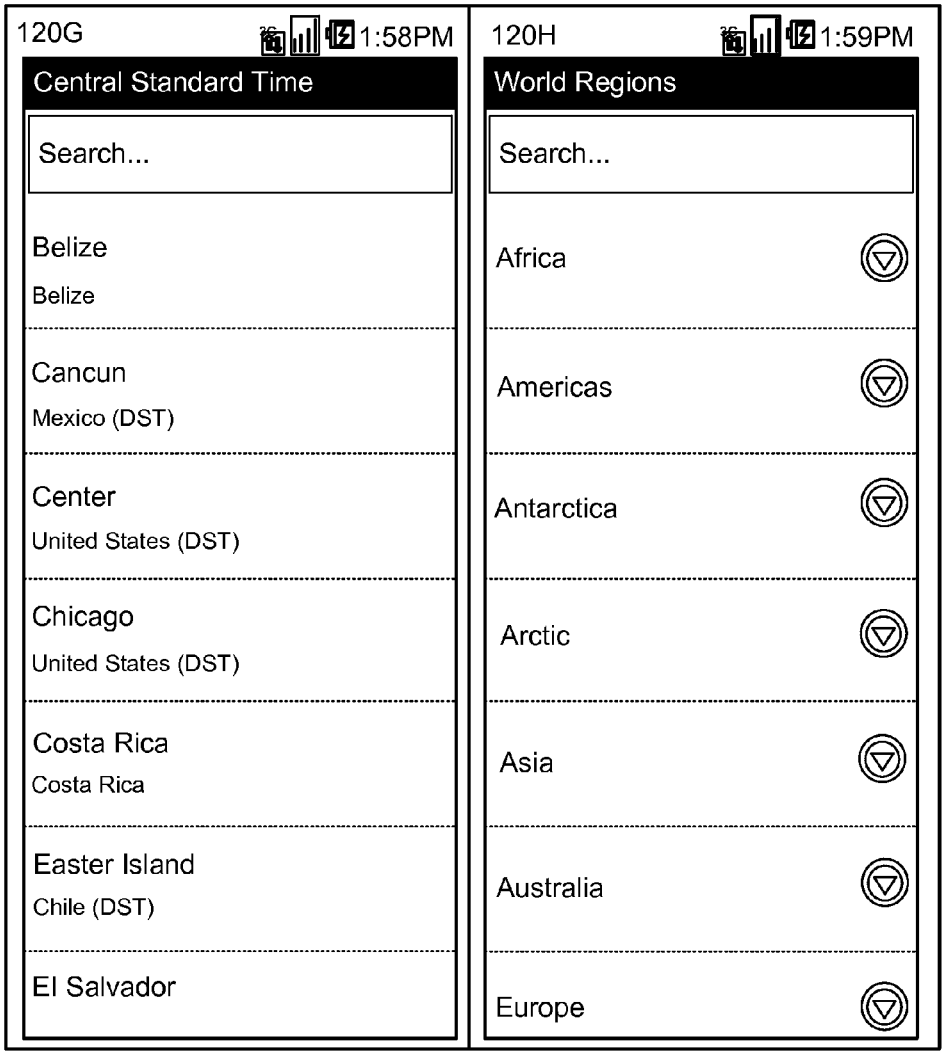

FIG. 4C illustrates a user interface 120G and a user interface 120H according to an embodiment. After the user selects the "Central Standard Time", the next level in the hierarchical list is displayed, as illustrated in user interface 120G. For example, the user interface 120G provides the time zones in the Central Standard Time. The time zones are differentiated by longitude, whether the time zone has DST, and when the DST begins and ends (not shown). Each of the items shown in the user interface 120G is a time zone and selecting any one of them completes the time zone selection task.

Referring back to user interface 120E of FIG. 4B, the user may select the world region category 178 from the top level of the hierarchal list, which then displays the user interface 120H—the next level in the hierarchal list. The world region category 178 organizes the time zones according to geographical regions. For example, the user interface 120H provides the geographical regions of Africa, America, Antarctica, Arctic, Asia, Australia, Europe, and others (if the user further scrolls down). The user may select the Americas option, which displays the following user interfaces 120.

Figure 4D:
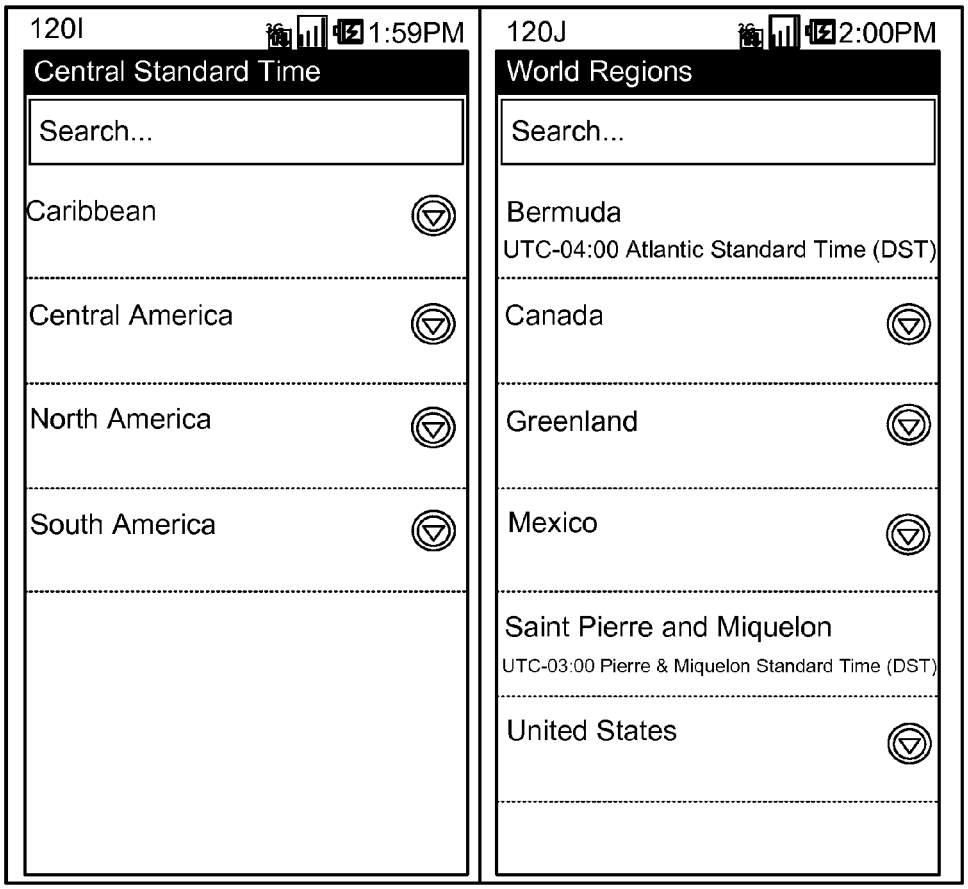

FIG. 4D illustrates a user interface 120I and a user interface 120J according to an embodiment. After the user selects the Americas option on the user interface 120H, the next level of the hierarchal list is displayed, which is illustrated in the user interface 120I. For instance, the next level of the hierarchal list (e.g., the Americas subtree) provides the name of the regions associated with the Americas option, which includes the Caribbean, Central America, North America, and South America. Accordingly, the user may choose the North America option, which displays the user interface 120J providing the North America subtree. As shown in the user interface 120J, the time zone provided for Bermuda and Saint Pierre and Miquelon is the actual time, not a collection of time zones. As such, if the user selects one of the Bermuda and Saint Pierre and Miquelon option, the clock selection task ends. However, if the user selects the United States option, the following user interfaces 120 are displayed.

Figure 4E:
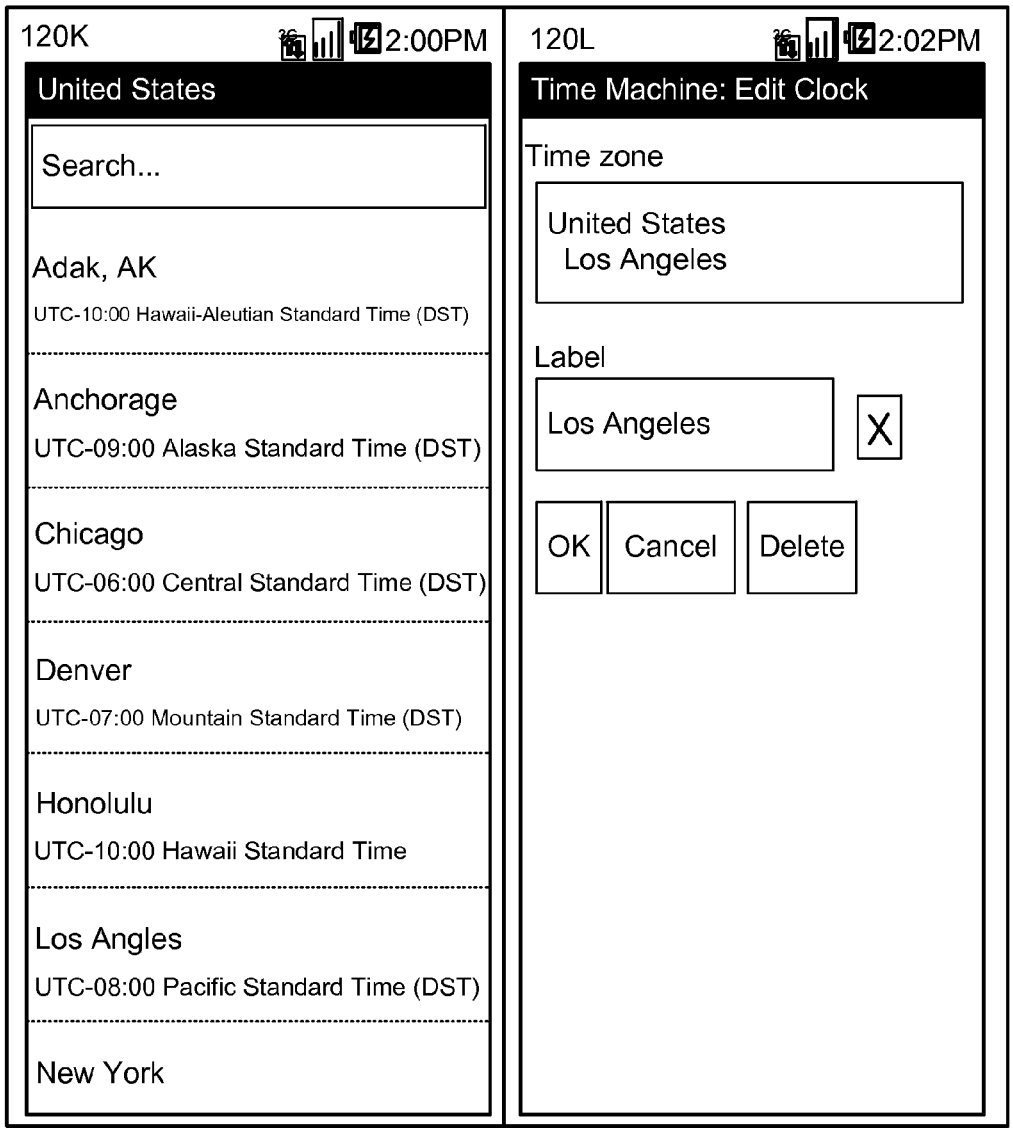

FIG. 4E illustrates a user interface 120K and a user interface 120L according to an embodiment. After the user selects the United States option from the user interface 120J, the user interface 120K is displayed providing the United States subtree. Each of the items shown in the user interface 120K is a time zone, and selecting any one of them completes the time zone selection task. Upon selecting a particular time zone, the user interface 120L is displayed. The selected time zone is shown in the top box, and selecting that box returns the user to the pick tree. Also, as shown in the user interface 120L, the display name of the time zone is adjustable by the user. For instance, the editable labels are initialized from the time zone name of the time zone attributes database 108.

Figure 5:
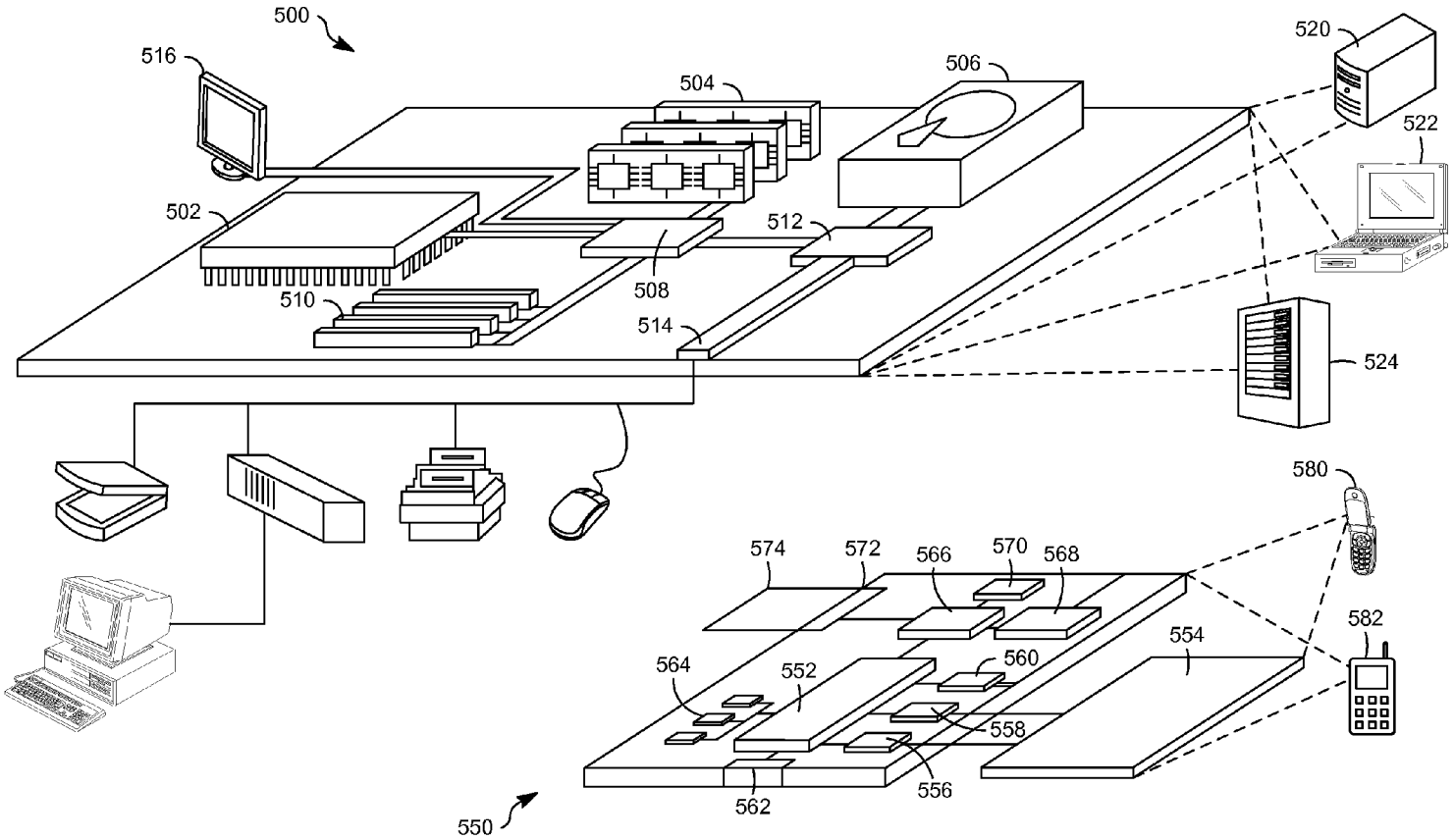
FIG. 5 is a block diagram showing example or representative computing devices and associated elements that may be used to implement the data processing apparatus 100 of FIG. 1A and its functions described in FIGS. 1-4.

FIG. 5 is a block diagram showing example or representative computing devices and associated elements that may be used to implement the data processing apparatus 100 of FIG. 1A as well as the functions explained with reference to FIGS. 1-4. FIG. 5 shows an example of a generic computer device 500 and a generic mobile computer device 550, which may be used with the techniques described here. Computing device 500 is intended to represent various forms of digital computers, such as laptops, desktops, workstations, personal digital assistants, servers, blade servers, mainframes, and other appropriate computers. Computing device 550 is intended to represent various forms of mobile devices, such as personal digital assistants, cellular telephones, smart phones, and other similar computing devices. The components shown here, their connections and relationships, and their functions, are meant to be examples only, and are not meant to limit implementations of the embodiments described and/or claimed in this document.

Computing device 500 includes a processor 502, memory 504, a storage device 506, a high-speed interface 508 connecting to memory 504 and high-speed expansion ports 510, and a low speed interface 512 connecting to low speed bus 514 and storage device 506. Each of the components 502, 504, 506, 508, 510, and 512, are interconnected using various busses, and may be mounted on a common motherboard or in other manners as appropriate. The processor 502 can process instructions for execution within the computing device 500, including instructions stored in the memory 504 or on the storage device 506 to display graphical information for a GUI on an external input/output device, such as display 516 coupled to high speed interface 508. In other implementations, multiple processors and/or multiple buses may be used, as appropriate, along with multiple memories and types of memory. Also, multiple computing devices 500 may be connected, with each device providing portions of the necessary operations (e.g., as a server bank, a group of blade servers, or a multi-processor system).

The memory 504 stores information within the computing device 500. In one implementation, the memory 504 is a volatile memory unit or units. In another implementation, the memory 504 is a non-volatile memory unit or units. The memory 504 may also be another form of computer-readable medium, such as a magnetic or optical disk.

The storage device 506 is capable of providing mass storage for the computing device 500. In one implementation, the storage device 506 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 504, the storage device 506, or memory on processor 502.

The high speed controller 508 manages bandwidth-intensive operations for the computing device 500, while the low speed controller 512 manages lower bandwidth-intensive operations. Such allocation of functions is an example only. In one implementation, the high-speed controller 508 is coupled to memory 504, display 516 (e.g., through a graphics processor or accelerator), and to high-speed expansion ports 510, which may accept various expansion cards (not shown). In the implementation, low-speed controller 512 is coupled to storage device 506 and low-speed expansion port 514. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 500 may be implemented in a number of different forms, as shown in the figure. For example, it may be implemented as a standard server 520, or multiple times in a group of such servers. It may also be implemented as part of a rack server system 524. In addition, it may be implemented in a personal computer such as a laptop computer 522. Alternatively, components from computing device 500 may be combined with other components in a mobile device (not shown), such as device 550. Each of such devices may contain one or more of computing device 500, 550, and an entire system may be made up of multiple computing devices 500, 550 communicating with each other.

Computing device 550 includes a processor 552, memory 564, an input/output device such as a display 554, a communication interface 566, and a transceiver 568, among other components. The device 550 may also be provided with a storage device, such as a microdrive or other device, to provide additional storage. Each of the components 550, 552, 564, 554, 566, and 568, are interconnected using various buses, and several of the components may be mounted on a common motherboard or in other manners as appropriate.

The processor 552 can execute instructions within the computing device 550, including instructions stored in the memory 564. The processor may be implemented as a chipset of chips that include separate and multiple analog and digital processors. The processor may provide, for example, for coordination of the other components of the device 550, such as control of user interfaces, applications run by device 550, and wireless communication by device 550.

Processor 552 may communicate with a user through control interface 558 and display interface 556 coupled to a display 554. The display 554 may be, for example, a TFT LCD (Thin-Film-Transistor Liquid Crystal Display) or an OLED (Organic Light Emitting Diode) display, or other appropriate display technology. The display interface 556 may comprise appropriate circuitry for driving the display 554 to present graphical and other information to a user. The control interface 558 may receive commands from a user and convert them for submission to the processor 552. In addition, an external interface 562 may be provide in communication with processor 552, so as to enable near area communication of device 550 with other devices. External interface 562 may provide, for example, for wired communication in some implementations, or for wireless communication in other implementations, and multiple interfaces may also be used.

The memory 564 stores information within the computing device 550. The memory 564 can be implemented as one or more of a computer-readable medium or media, a volatile memory unit or units, or a non-volatile memory unit or units. Expansion memory 574 may also be provided and connected to device 550 through expansion interface 572, which may include, for example, a SIMM (Single In Line Memory Module) card interface. Such expansion memory 574 may provide extra storage space for device 550, or may also store applications or other information for device 550. Specifically, expansion memory 574 may include instructions to carry out or supplement the processes described above, and may include secure information also. Thus, for example, expansion memory 574 may be provide as a security module for device 550, and may be programmed with instructions that permit secure use of device 550. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 564, expansion memory 574, or memory on processor 552, that may be received, for example, over transceiver 568 or external interface 562.

Device 550 may communicate wirelessly through communication interface 566, which may include digital signal processing circuitry where necessary. Communication interface 566 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 568. In addition, short-range communication may occur, such as using a Bluetooth, WiFi, or other such transceiver (not shown). In addition, GPS (Global Positioning system) receiver module 570 may provide additional navigation- and location-related wireless data to device 550, which may be used as appropriate by applications running on device 550.

Device 550 may also communicate audibly using audio codec 560, which may receive spoken information from a user and convert it to usable digital information. Audio codec 560 may likewise generate audible sound for a user, such as through a speaker, e.g., in a handset of device 550. Such sound may include sound from voice telephone calls, may include recorded sound (e.g., voice messages, music files, etc.) and may also include sound generated by applications operating on device 550.

The computing device 550 may be implemented in a number of different forms, as shown in the figure. For example, it may be implemented as a cellular telephone 580. It may also be implemented as part of a smart phone 582, personal digital assistant, or other similar mobile device.

Thus, various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

It will be appreciated that the above embodiments that have been described in particular detail are merely example or possible embodiments, and that there are many other combinations, additions, or alternatives that may be included.

Also, the particular naming of the components, capitalization of terms, the attributes, data structures, or any other programming or structural aspect is not mandatory or significant, and the mechanisms that implement the embodiments or their features may have different names, formats, or protocols. Further, the system may be implemented via a combination of hardware and software, as described, or entirely in hardware elements. Also, the particular division of functionality between the various system components described herein is merely an example, and not mandatory; functions performed by a single system component may instead be performed by multiple components, and functions performed by multiple components may instead performed by a single component.

Some portions of above description present features in terms of algorithms and symbolic representations of operations on information. These algorithmic descriptions and representations may be used by those skilled in the data processing arts to most effectively convey the substance of their work to others skilled in the art. These operations, while described functionally or logically, are understood to be implemented by computer programs. Furthermore, it has also proven convenient at times, to refer to these arrangements of operations as modules or by functional names, without loss of generality.

Unless specifically stated otherwise as apparent from the above discussion, it is appreciated that throughout the description, discussions utilizing terms such as "processing" or "computing" or "calculating" or "determining" or "displaying" or "providing" or the like, refer to the action and processes of a computer system, or similar electronic computing device, that manipulates and transforms data represented as physical (electronic) quantities within the computer system memories or registers or other such information storage, transmission or display devices.

What is claimed is:

1. A system, comprising:

at least one processor;

a memory, coupled to the at least one processor, storing instructions that, when executed by the at least one processor, cause the system to perform a method that includes:

receiving indications of a set of selected time zones of a plurality of available time zones;

defining a plurality of clock objects, each respective clock object of the plurality of clock objects providing a visual indicator for a different respective time zone of the set of selected time zones;

outputting, for display, a user interface including an arrangement of the plurality of clock objects;

responsive to receiving a command to shift to a travel mode, updating the plurality of clock objects, the updating including:

providing, for each respective selected time zone of the set of selected time zones, an updated local time corresponding to a travel mode time for the respective selected time zone, and adjusting, for each respective selected time zone of the set of selected time zones, the visual indicator for the respective selected time zone according to the updated local time for the respective selected time zone; and defining a hierarchical list of the plurality of available time zones arranged in a tree structure, the tree structure having a plurality of levels, wherein outputting, for display, the user interface is responsive to receiving a command to edit the set of selected time zones and the plurality of available time zones is displayed according to the hierarchical list arrangement.

2. The system of claim 1, wherein updating the plurality of clock objects comprises updating the plurality of clock objects over a period of time having a plurality of time intervals such that a local time is updated and the visual indicator is adjusted at each time interval according to a travel mode time at a respective time interval.

3. The system of claim 1, wherein the indications of the set of selected time zones indicate a selection of a default number of time zones.

4. The system of claim 1, wherein the method performed by system further includes:

storing the set of selected time zones in a user preferences database, wherein the indications of the set of selected time zones of the plurality of available time zones indicate the set of selected times zones being obtained from the user preferences database.

5. The system of claim 1, wherein each clock object includes a background color, and wherein the method performed by the system further includes changing the background color for each clock object according to the updated local time for a respective selected time zone.

6. The system of claim 1, wherein at least one of the plurality of clock objects includes a time zone indicator that indicates a current time zone associated with a user.

7. The system of claim 1, wherein the visual indicator includes one of a visual representation of a sun and a visual representation of a moon.

8. The system of claim 1, wherein adjusting the visual indicator according to the updated local time for each time zone of the set of selected time zones includes outputting, for display, the visual indicator based at least in part on a velocity of a movement associated with an input gesture by a user.

9. The system of claim 1, wherein receiving the command to shift to the travel mode includes receiving information indicating an input gesture from a user.

10. The system of claim 1, wherein the method performed by the system further includes launching an application based on a secondary command.

11. The system of claim 10, wherein the application is one of a calendar application, a voice application, and a text message application.

12. The system of claim 11, wherein launching the application includes populating a calendar entry of the calendar application with the updated local time.

13. A method, comprising:

receiving, at a computing device, indications of a set of selected time zones of a plurality of available time zones;

defining, by the computing device, a plurality of clock objects, each respective clock object of the plurality of clock objects providing a visual indicator for a different respective time zone of the set of selected time zones;

outputting, by the computing device, for display, a user interface including an arrangement of the plurality of clock objects;

responsive to receiving, at the computing device, a command to shift to a travel mode, updating, by the computing device, the plurality of clock objects, the updating including:

providing, for each respective selected time zone of the subset of selected time zones, an updated local time corresponding to a travel mode time for the respective selected time zone, and adjusting, for each respective selected time zone of the set of selected time zones, the visual indicator for the respective selected time zone according to the updated local time for the respective selected time zone; and defining a hierarchical list of the plurality of available time zones arranged in a tree structure, the tree structure having a plurality of levels, wherein outputting, for display, the user interface is responsive to receiving a command to edit the set of selected time zones, and the plurality of available time zones is displayed according to the hierarchical list arrangement.

14. The method of claim 13, wherein updating the plurality of clock objects includes:

updating, by the computing device, the plurality of clock objects over a period of time having a plurality of time intervals such that a local time is updated and the visual indicator is adjusted at each time interval according to a travel mode time at a respective time interval.

15. The method of claim 13, wherein each clock object includes a background color, and wherein updating the plurality of clock objects according to the command includes:

changing, by the computing device, the background color for each clock object according to an updated local time for a respective selected time zone.

16. The method of claim 13, wherein the visual indicator includes one of a visual representation of a sun and a visual representation of a moon.

17. The method of claim 13, wherein adjusting the visual indicator according to the updated local time for each time zone of the set of selected time zones includes outputting, by the computing device, for display, the visual indicator based at least in part on a velocity of movement associated with an input gesture by a user.

18. A non-transitory computer-readable medium storing instructions that, when executed by one or more processors, cause a computing device to:

receive indications of a set of selected time zones of a plurality of available time zones;

define a plurality of clock objects, each respective clock object of the plurality of clock objects providing a visual indicator for a different respective time zone of the set of selected time zones;

output, for display, a user interface including an arrangement of the plurality of clock objects;

responsive to receiving a command to shift to a travel mode, update the plurality of clock objects, the updating including:

providing, for each respective selected time zone of the subset of selected time zones, an updated local time corresponding to a travel mode time for the respective selected time zone, and adjusting, for each respective selected time zone of the set of selected time zones, the visual indicator for the respective selected time zone according to the updated local time for the respective selected time zone; and define a hierarchical list of the plurality of available time zones arranged in a tree structure, the tree structure having a plurality of levels, wherein outputting, for display, the user interface is responsive to receiving a command to edit the set of selected time zones, and the plurality of available time zones is displayed according to the hierarchical list arrangement.

19. The non-transitory computer-readable medium of claim 18, wherein updating the plurality of clock objects includes updating the plurality of clock objects over a period of time having a plurality of time intervals such that a local time is updated and the visual indicator is adjusted at each time interval according to a travel mode time at a respective time interval.

20. The non-transitory computer-readable medium of claim 18, wherein adjusting the visual indicator according to the updated local time for each selected time zone of the set of selected time zones includes outputting, for display, the visual indicator based at least in part on a velocity of movement associated with an input gesture by a user.

* * * * *